US010532242B2

(12) United States Patent
Donchenko et al.

(10) Patent No.: US 10,532,242 B2
(45) Date of Patent: Jan. 14, 2020

(54) APPARATUS AND METHOD FOR EXERCISING WITH A CHILD ATTACHED TO THE LEGS

(71) Applicant: FIT FAMILY INCORPORATED, Folsom, CA (US)

(72) Inventors: Jennifer Donchenko, Folsom, CA (US); Daniil Donchenko, Folsom, CA (US)

(73) Assignee: FIT FAMILY INCORPORATED, Folsom, CA (US)

( * ) Notice: Subject to any disclaimer, the term of this patent is extended or adjusted under 35 U.S.C. 154(b) by 0 days.

(21) Appl. No.: 16/416,193

(22) Filed: May 18, 2019

(65) Prior Publication Data

US 2019/0269959 A1 Sep. 5, 2019

Related U.S. Application Data

(63) Continuation of application No. 15/957,793, filed on Apr. 19, 2018, now Pat. No. 10,300,325, which is a (Continued)

(51) Int. Cl.

| | |
|---|---|
| ***A63B 21/065*** | (2006.01) |
| ***A63B 21/28*** | (2006.01) |
| ***A63B 21/00*** | (2006.01) |
| ***A63B 23/035*** | (2006.01) |
| ***A41D 15/04*** | (2006.01) |

(Continued)

(52) U.S. Cl.

CPC ..... *A63B 21/28* (2013.01); *A41B 13/06* (2013.01); *A41D 15/04* (2013.01); *A47D 13/025* (2013.01); *A63B 21/065* (2013.01); *A63B 21/0608* (2013.01); *A63B 21/4011* (2015.10); *A63B 23/03525* (2013.01); *A63B 23/0494* (2013.01); *A63B 21/0601* (2013.01); *A63B 21/4039* (2015.10); *A63B 2208/12* (2013.01)

(58) Field of Classification Search

CPC .... A47D 13/02; A47D 13/025; A63B 21/065; A63B 21/4011; A63B 2208/12; A63B 21/0601; A63B 21/28; A63B 23/0494

USPC ..... 224/158–160

See application file for complete search history.

(56) References Cited

U.S. PATENT DOCUMENTS

| | | | |
|---|---|---|---|
| 4,333,591 | A | 6/1982 | Case |
| 4,436,233 | A | 3/1984 | Hill |

(Continued)

FOREIGN PATENT DOCUMENTS

| | | |
|---|---|---|
| WO | WO1995005952 | 3/1995 |

OTHER PUBLICATIONS

"Post Pregnancy Exercise", https://web.archive.org/web/20160716165721/https://www.running-mom.com/postpregnancyexercise.html, retrieved Aug. 6, 2019. (Year: 2016).*

(Continued)

*Primary Examiner* — Adam J Waggenspack

(74) *Attorney, Agent, or Firm* — Jim H. Salter; Inventive Law Inc.

(57) ABSTRACT

An apparatus and method for exercising with a child attached to the legs is disclosed. An example embodiment includes: a child wrap element having a portion that can be wrapped around and secure a child; a leg wrap portion having at least one loop that can be secured to the legs of a user; and a connecting portion integrated between the child wrap portion and the leg wrap portion.

8 Claims, 26 Drawing Sheets

Related U.S. Application Data continuation-in-part of application No. 15/344,527, filed on Nov. 6, 2016, now Pat. No. 10,300,327.

(51) Int. Cl.

| | |
|---|---|
| ***A41B 13/06*** | (2006.01) |
| ***A63B 21/06*** | (2006.01) |
| ***A63B 23/04*** | (2006.01) |
| ***A47D 13/02*** | (2006.01) |

(56) References Cited

U.S. PATENT DOCUMENTS

| | | | | |
|---|---|---|---|---|
| 4,469,259 | A | 9/1984 | Krich | |
| 5,243,724 | A | 9/1993 | Barnes | |
| 5,611,095 | A | 3/1997 | Schneider | |
| 5,700,059 | A | 12/1997 | Moscot | |
| 5,852,827 | A | 12/1998 | Lear | |
| 5,971,900 | A * | 10/1999 | Miller | A61H 1/0218 128/876 |
| 6,039,677 | A * | 3/2000 | Spletzer | A63B 21/0605 2/22 |
| 7,465,263 | B1 | 12/2008 | Conrad | |
| 8,752,739 | B2 | 6/2014 | Bergkvist | |
| 9,032,963 | B2 | 5/2015 | Grissom | |
| 9,295,341 | B2 * | 3/2016 | Sonnenberg | A47D 13/02 |
| D752,855 | S | 4/2016 | Halverstadt | |
| 9,326,619 | B2 * | 5/2016 | Krass | A47D 13/02 |
| 9,596,947 | B2 | 3/2017 | Lee | |
| 9,750,352 | B2 | 9/2017 | Harris | |
| 10,300,325 | B2 | 5/2019 | Donchenko | |
| 10,300,327 | B2 | 5/2019 | Donchenko | |
| 2005/0218168 | A1 | 10/2005 | Chua | |
| 2005/0274767 | A1 | 12/2005 | Lyle | |
| 2007/0029356 | A1 | 2/2007 | Moriguchi | |
| 2008/0018163 | A1 | 1/2008 | Winn | |
| 2008/0313812 | A1 | 12/2008 | Reeves | |
| 2009/0045233 | A1 | 2/2009 | Garofalo | |
| 2012/0152987 | A1 | 6/2012 | Beltrame | |
| 2012/0286002 | A1 * | 11/2012 | Dardel | A47D 13/025 224/159 |
| 2014/0231473 | A1 * | 8/2014 | Bailey | A47D 13/025 224/160 |
| 2014/0283277 | A1 * | 9/2014 | Wilhelm | A41B 13/00 2/69.5 |
| 2014/0284361 | A1 | 9/2014 | Wang | |
| 2014/0296045 | A1 * | 10/2014 | Krstanoski-Blazeski | A47D 13/025 482/139 |
| 2015/0272342 | A1 | 10/2015 | Schaarschmidt | |
| 2016/0023051 | A1 | 1/2016 | Lauener | |
| 2016/0120333 | A1 | 5/2016 | Brandner | |
| 2016/0174731 | A1 | 6/2016 | Pulley | |
| 2016/0331151 | A1 * | 11/2016 | Miller-Hanna | A47D 13/025 |
| 2017/0318866 | A1 * | 11/2017 | Fraser | A41B 13/04 |

OTHER PUBLICATIONS

Webpages from http://www.miraclestretch.com/; download date/time Dec. 18, 2016 8:50:58 AM.

* cited by examiner

APPARATUS AND METHOD FOR EXERCISING WITH A CHILD ATTACHED TO THE LEGS

PRIORITY PATENT APPLICATIONS

This is a continuation patent application drawing priority from U.S. patent application Ser. No. 15/957,793; filed Apr. 19, 2018, issued as U.S. patent Ser. No. 10/300,325 on May 28, 2019; which is a continuation-in-part patent application drawing priority from U.S. patent application Ser. No. 15/344,527; filed Nov. 6, 2016, issued as U.S. patent Ser. No. 10/300,327 on May 28, 2019. This present patent application claims priority to the referenced patent applications. The entire disclosure of the referenced patent applications is considered part of the disclosure of the present application and is hereby incorporated by reference herein in its entirety.

TECHNICAL FIELD

The disclosed subject matter relates to the field of exercise equipment, child harnesses, wraps, garments and apparel, and particularly although not exclusively, to an apparatus and method for exercising with a child attached to the legs.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the disclosure provided herein and to the drawings that form a part of this document: Copyright 2015-2019, Jennifer and Daniil Donchenko; All Rights Reserved.

BACKGROUND

Parents of young children often find it difficult to balance the care needs of the children with the fitness needs of the parents. For example, post-natal exercise is frequently recommended for new mothers in an attempt to restore strength and muscle tone to the mother's body after pregnancy. In general, regular exercise and a fitness regimen is recommended for all adults. However, a problem arises in that the demands on a parent's time from children and the parent's other responsibilities frequently prevent the parent from engaging in a regular exercise program. In addition, parents are often reluctant to leave babies, toddlers, or young children with another party while engaging in an exercise program. If a parent attempts to exercise in the presence of the baby, toddler, or young child, it is often the case that the baby, toddler, or young child will become distracted by the surroundings and uncomfortable with the lack of interaction with the parent. This, in turn, will distract the parent from their exercise program. As a result, the child becomes unhappy with the lack of engagement with the parent and the parent becomes frustrated with the inability to complete their exercise program.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there is disclosed and claimed an apparatus and method for exercising with a child attached to the legs. The example embodiments disclosed herein provide an apparatus, which allows easy and secure attachment of a child to the lower legs of an adult or user, and enabling the adult or user to exercise with the child securely attached to the legs of the adult/user. The example embodiments presented herein provide a way for children to be involved with and part of an adult's exercise regimen, while providing a fun activity for the child.

Figure 1:
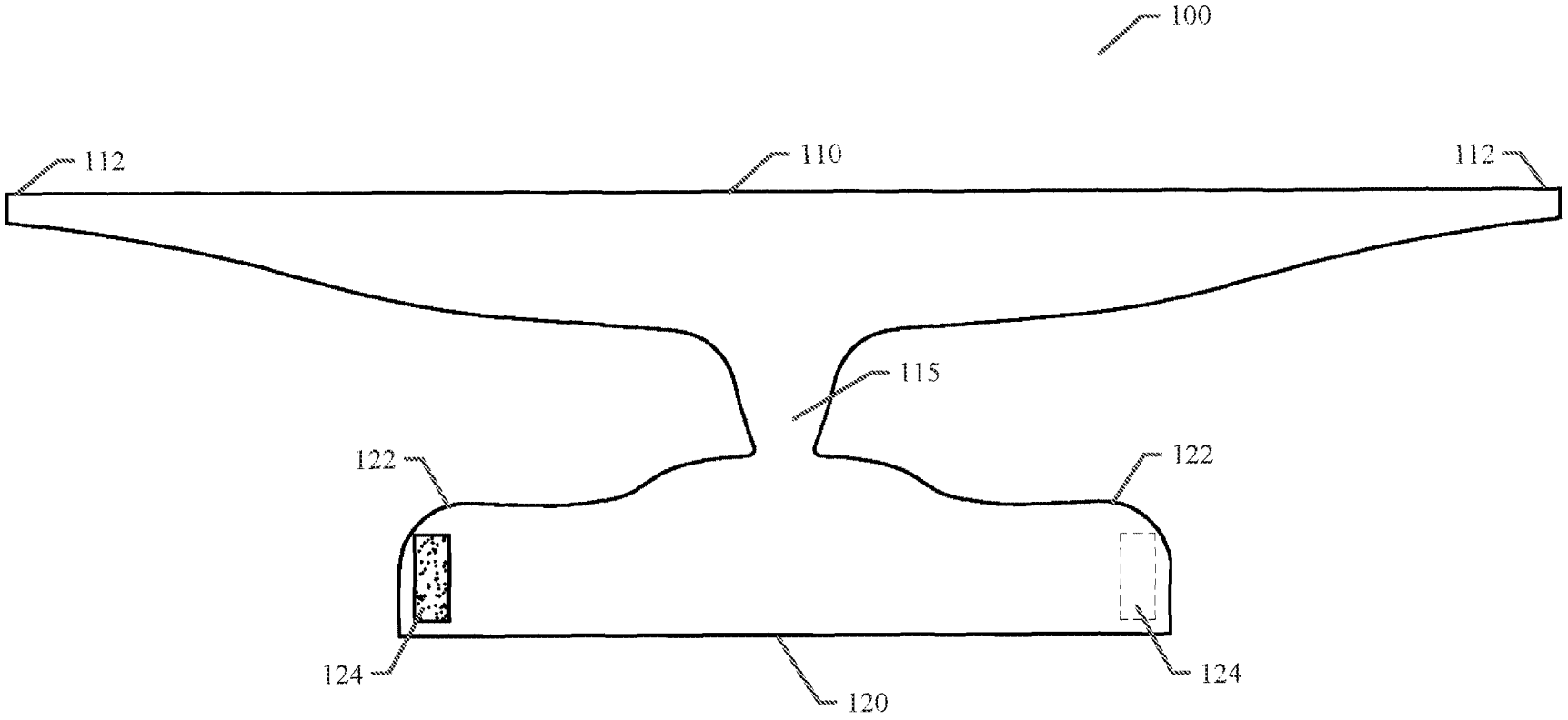
FIG. 1 illustrates a top plan view of a leg-attachable child wrap with tied ends according to an example embodiment.

FIG. 1 illustrates a top plan view of a leg-attachable child wrap 100 with tied ends according to an example embodiment. The illustrated example embodiment is shown to include a child wrap portion 110 having securing ends 112 that can be wrapped around and secure a child placed therebetween. The leg-attachable child wrap 100 further includes a leg wrap portion 120 having securing ends 122 that can be wrapped around and attached to the legs of a user. The leg-attachable child wrap 100 further includes a connecting portion 115 integrated between the child wrap portion 110 and the leg wrap portion 120. In an alternative embodiment, the connecting portion 115 can be detachable to enable connection or separation of the child wrap portion 110 to/from the leg wrap portion 120.

In the various example embodiments, the leg-attachable child wrap 100 can be manufactured from a variety of well-known materials or fabrics, such as cotton, synthetic materials, wool, canvas, plastic, Gortex™, linen, woven or knitted materials, rubber, and the like. Various example embodiments can use water-resistant materials, waterproof materials, flame or fire retardant materials, non-allergenic materials, anti-bacterial materials, and the like. Additionally, the leg-attachable child wrap 100 can be manufactured from a variety of all natural fibers including plant and animal fibers bamboo, silk, hemp, flax, ramie, mohair, camel hair, cashmere, angora wool, alpaca wool, and the like. All types of industrial manufacturing and handmade materials can also be used, including seamless, knitted, crocheted, woven, macrame, quilted, and sewn materials.

The example embodiment shown in FIG. 1 includes a child wrap portion 110 having securing ends 112 that can be wrapped around and tied together to secure a child placed therebetween. In contrast, FIGS. 12 through 16, described in more detail below, illustrate an embodiment wherein the securing ends 212 can be fastened together with a hook and loop fastener (e.g., Velcro™). It will be apparent to those of ordinary skill in the art that either tied securing ends 112, fastened securing ends 212, or other methods can be used to wrap the child wrap portion 110 around a child and securely attach the ends 112 to secure a child placed therebetween.

The example embodiment shown in FIG. 1 also includes a leg wrap portion 120 having securing ends 122 that can be wrapped around and attached to the legs of a user by use of releasable fasteners 124 (e.g., hook and loop or Velcro™ strips). In alternative embodiments, the releasable fasteners 124 can be implemented as buckles, clips, ratchets, slide catches, buttons, or other means for securely attached securing ends 122 together. It will be apparent to those of ordinary skill in the art that the outline shape of the child wrap portion 110 and the leg wrap portion 120 can vary somewhat as long as the child wrap portion 110 can wrap around and secure a child and the leg wrap portion 120 can wrap around and secure the legs of the user.

FIGS. 2 through 11, described in more detail below, illustrate a method for using the leg-attachable child wrap 100 with tied ends as shown in FIG. 1. In general, the method involves three main processes: 1) attaching the leg wrap portion 120 to the legs of a user; 2) securing a child into the child wrap portion 110; and commencing an exercise regimen with the child securely attached to the legs of the user. These general processes of an example embodiment are described in more detail below.

Figure 2:
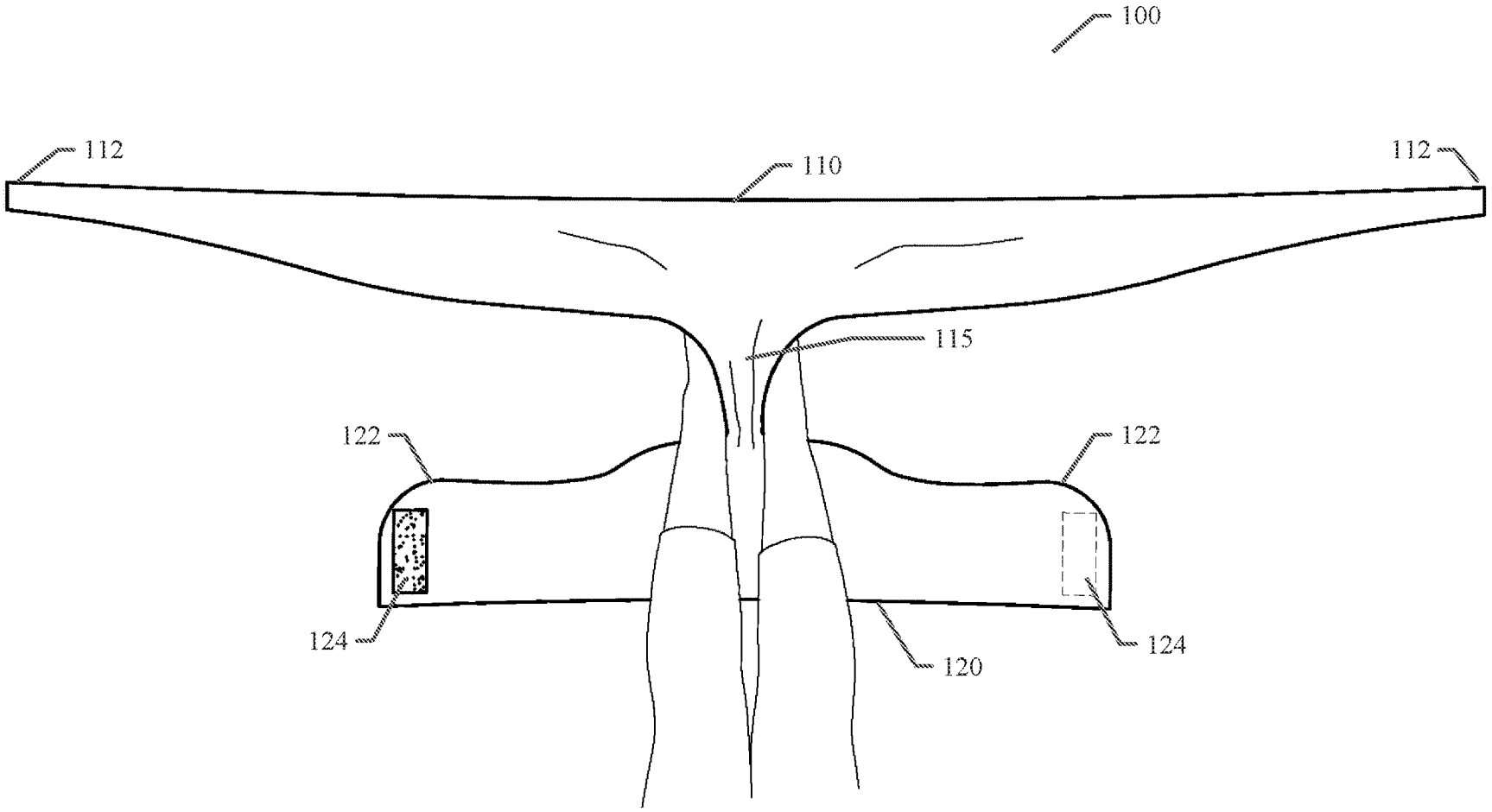
FIG. 2 illustrates a top plan view of the leg-attachable child wrap with tied ends showing the placement of the adult's or user's legs relative to a connecting portion according to an example embodiment.

FIG. 2 illustrates a top plan view of the leg-attachable child wrap 100 with tied ends showing the placement of the adult's or user's legs relative to a connecting portion 115 according to an example embodiment. Initially, the user can position his/her legs so the legs straddle the connecting portion 115 near the lower portion of the legs as shown. The legs can be positioned on top of the leg wrap portion 120 and underneath the child wrap portion 110.

Figure 3:
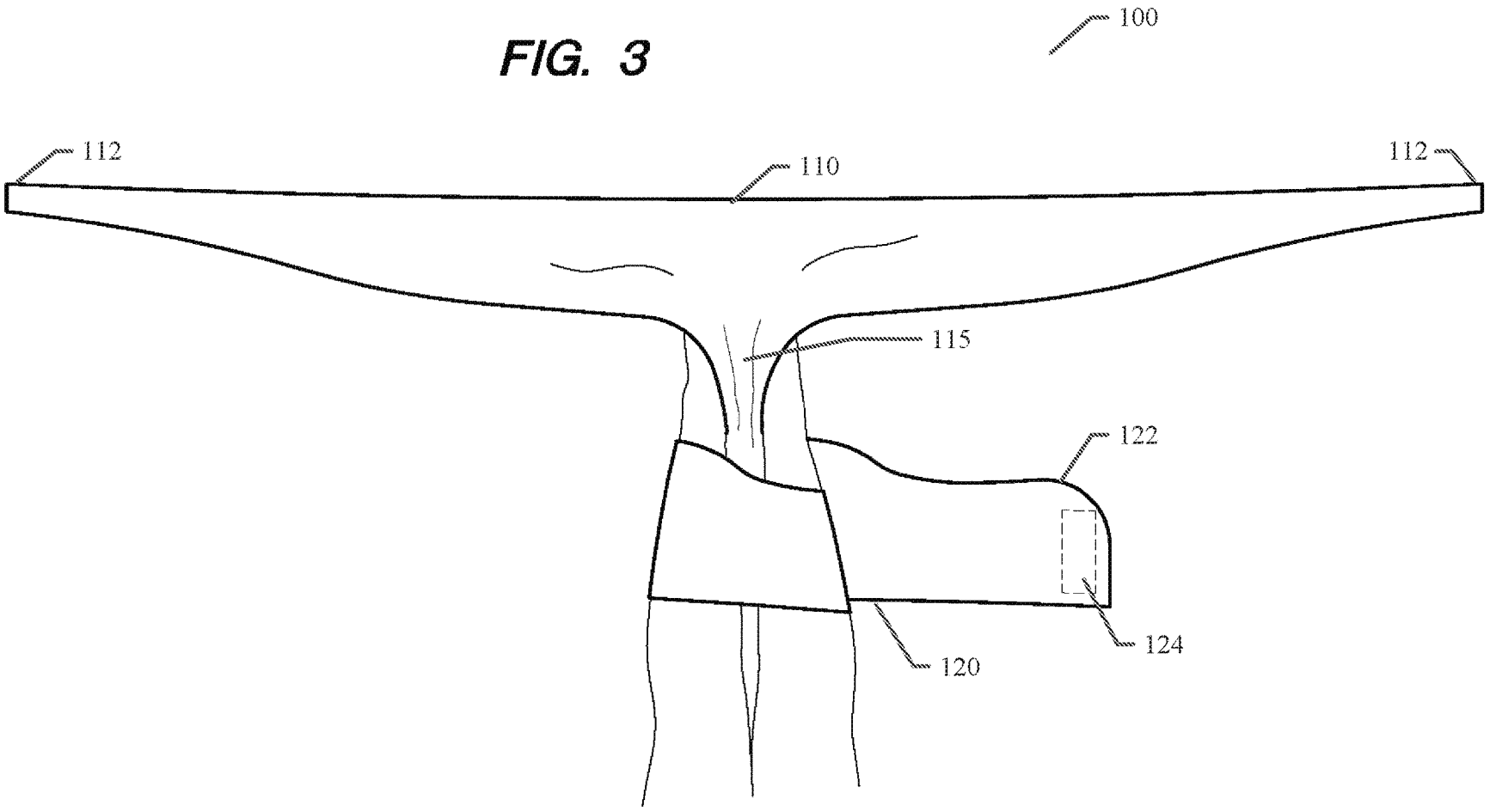
FIGS. 3 and 4 illustrate views of the leg-attachable child wrap with tied ends showing the wrapping of the adult's legs with a leg wrap portion according to an example embodiment.
Figure 4:
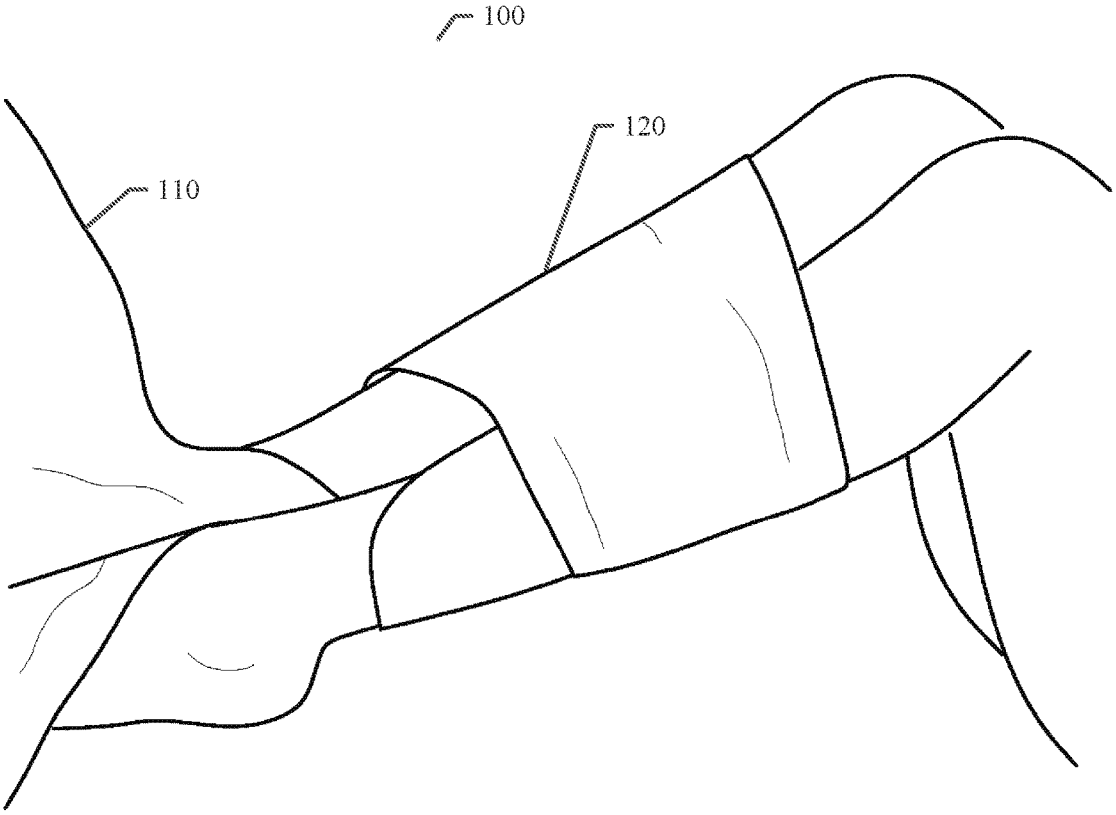

FIGS. 3 and 4 illustrate views of the leg-attachable child wrap 100 with tied ends showing the wrapping of the adult's legs with a leg wrap portion 120 according to an example embodiment. The user's legs can be wrapped tightly and securely with the leg wrap portion 120 and the securing ends 122 can be attached with the releasable fasteners 124. As a result, the leg-attachable child wrap 100 is securely attached to the legs of the user. In an alternative embodiment, the leg wrap portion 120 can be securely held in place using a separate mechanism, such as a belt, tie wrap, or other separate securing means.

Figure 5:
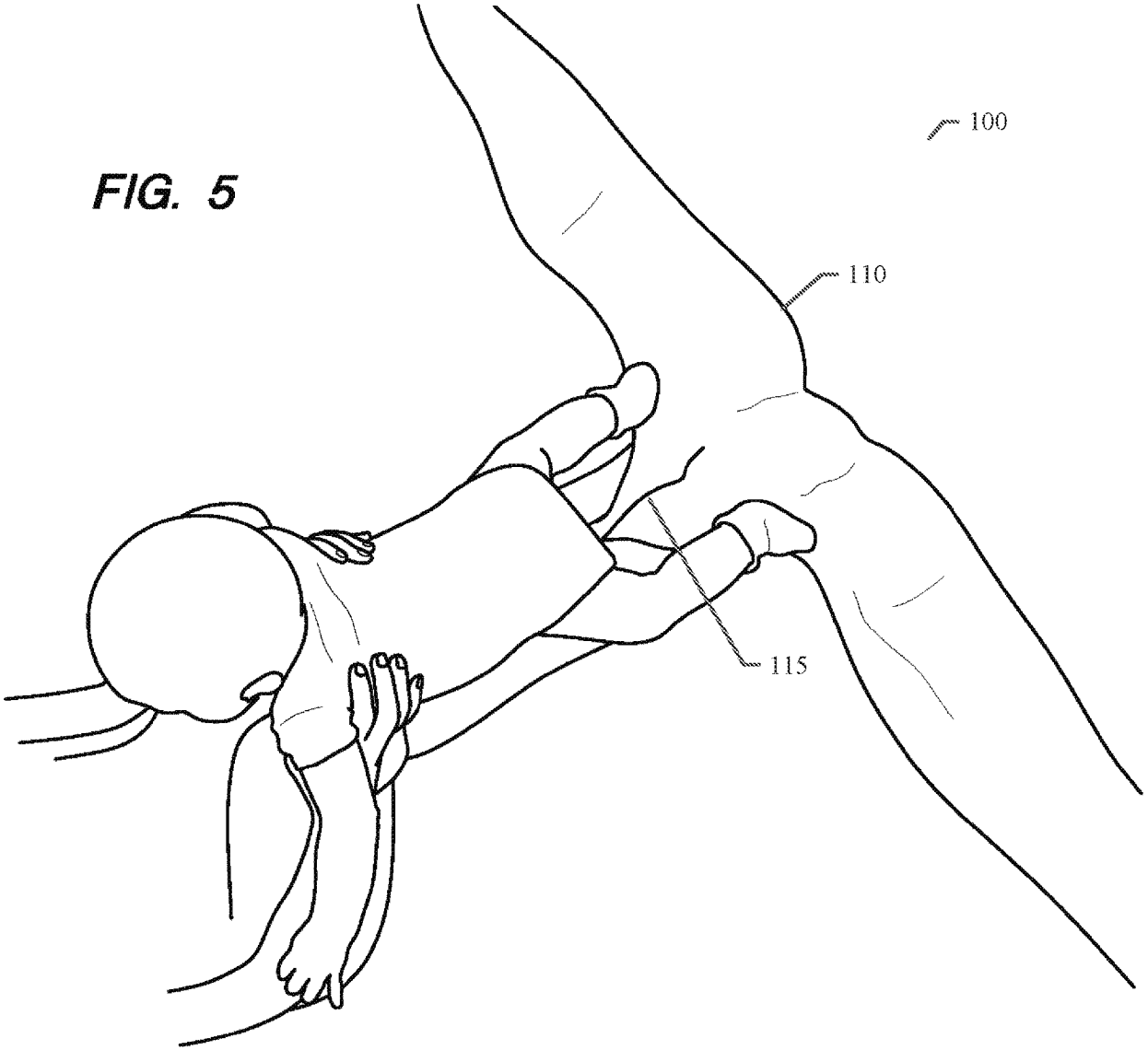
FIG. 5 illustrates an elevated view of the leg-attachable child wrap with tied ends showing the placement of a child relative to the connecting portion according to an example embodiment.

FIG. 5 illustrates an elevated view of the leg-attachable child wrap 100 with tied ends showing the placement of a child relative to the connecting portion 115 according to an example embodiment. Once the user's legs are wrapped tightly and securely with the leg wrap portion 120 as described above, a child can be positioned so the legs of the child straddle the connecting portion 115 as shown. The body of the child can be positioned on top of the user's lower legs and on top of the leg wrap portion 120. The body of the child can be positioned so a part of the child wrap portion 110 can be pulled between the child's legs. In the example embodiment, the child can be positioned in a variety of ways depending on the wishes of the child and the adult/user. For example, as described in more detail below, the child can be positioned in several ways, including: 1) in a head up (e.g., the child's head is toward or closest to the user/adult's head), prone position; 2) in a head up (e.g., the child's head is toward or closest to the user/adult's head), supine position; 3) in a head down (e.g., the child's head is toward or closest to the user/adult's feet), prone position; or 4) in a head down (e.g., the child's head is toward or closest to the user/adult's feet), supine position. In each case, the various embodiments described herein support the child as securely attached to the legs of the user.

Figure 6:
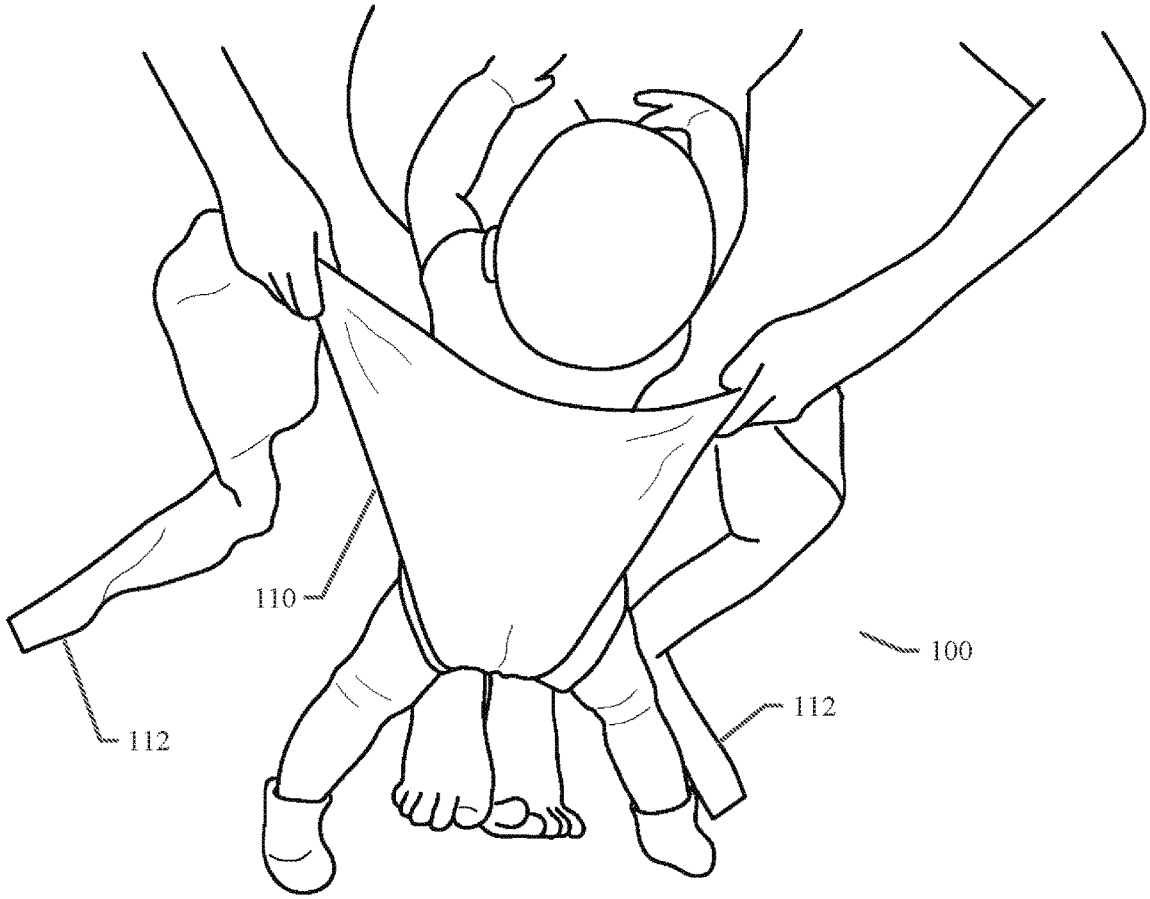
FIGS. 6 through 8 illustrate views of the leg-attachable child wrap with tied ends showing the wrapping of the child with a child wrap portion according to an example embodiment.
Figure 7:
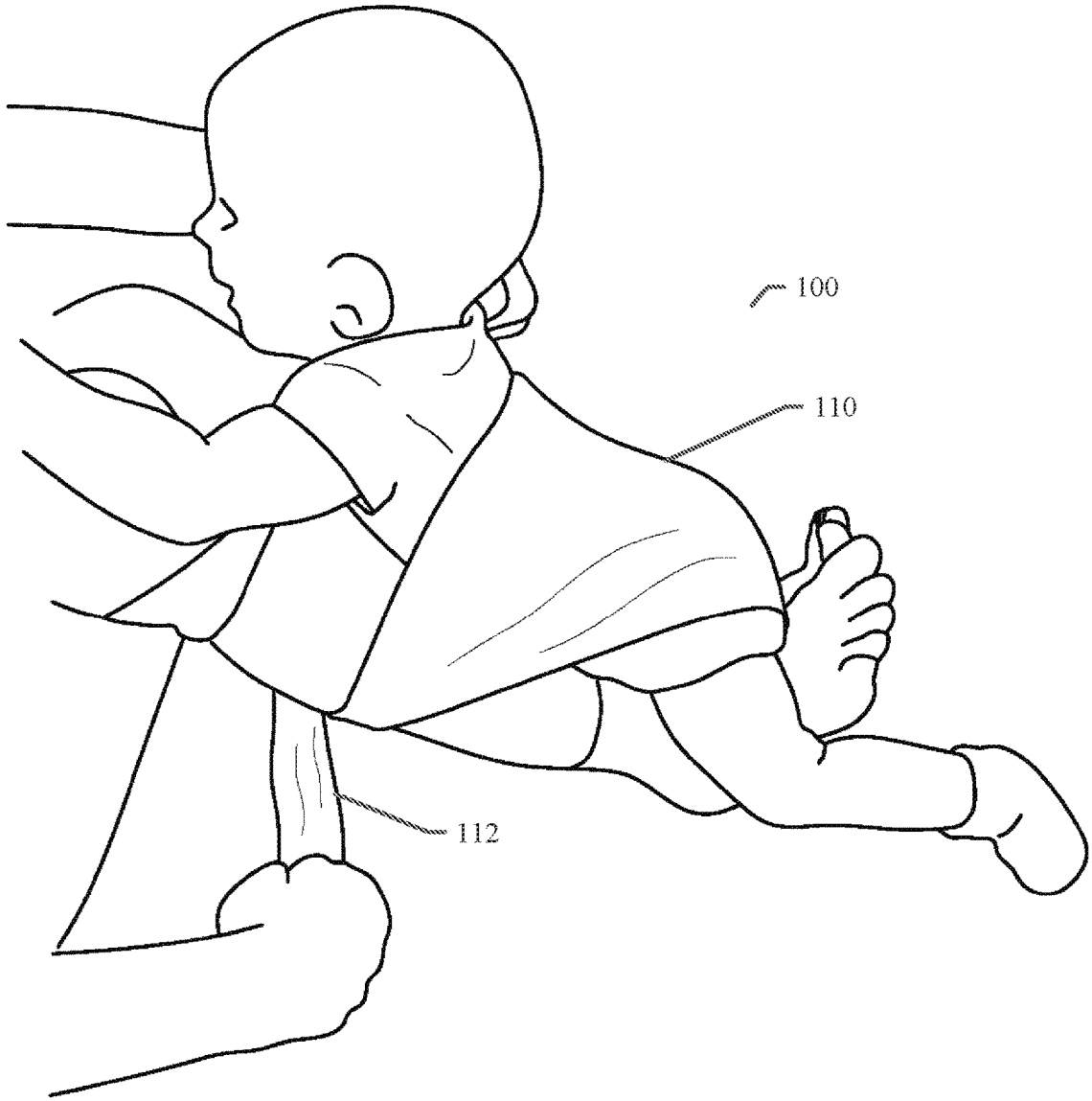
Figure 8:
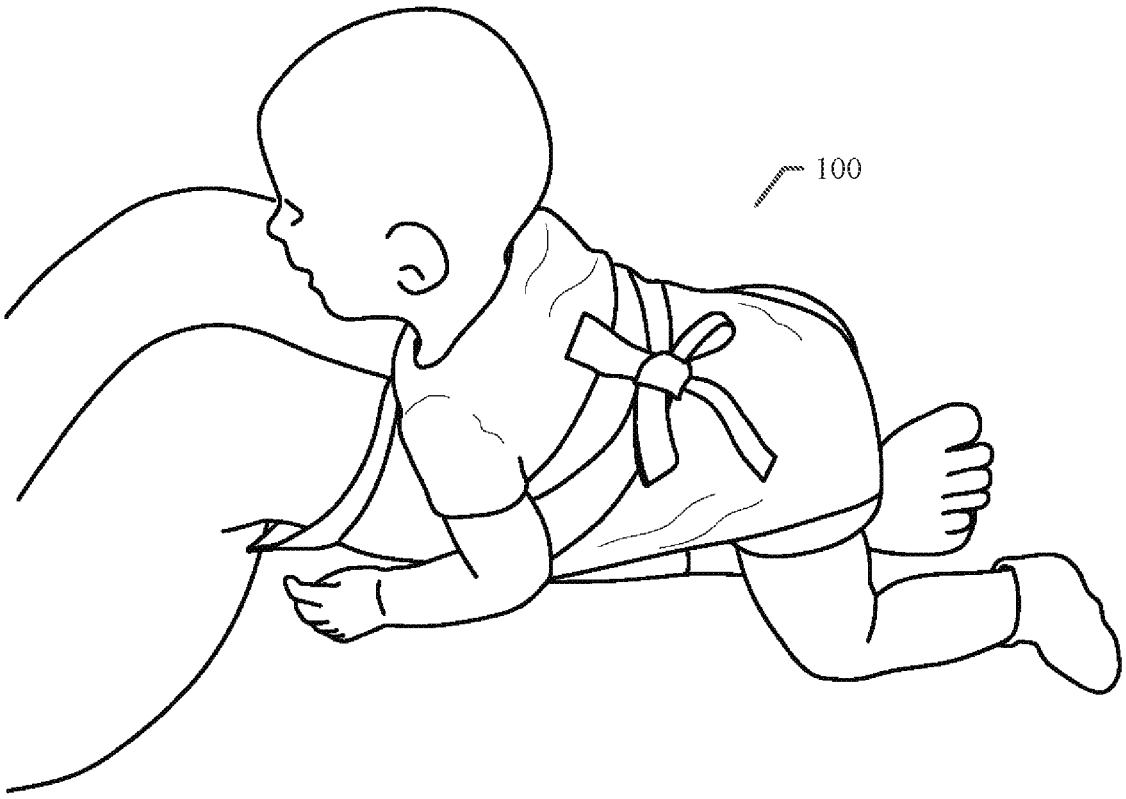

FIGS. 6 through 8 illustrate views of the leg-attachable child wrap 100 with tied ends showing the wrapping of the child with a child wrap portion 110 according to an example embodiment. Once the body of the child is positioned on top of the user's lower legs and on top of the leg wrap portion 120 as shown in FIG. 5, a part of the child wrap portion 110 can be pulled between the child's legs as shown in FIG. 6. Then, the securing ends 112 of the child wrap portion 110 can be wrapped around the child and tied together as shown in FIGS. 7 and 8. As a result, the child is securely attached to the legs of the user.

Figure 9:
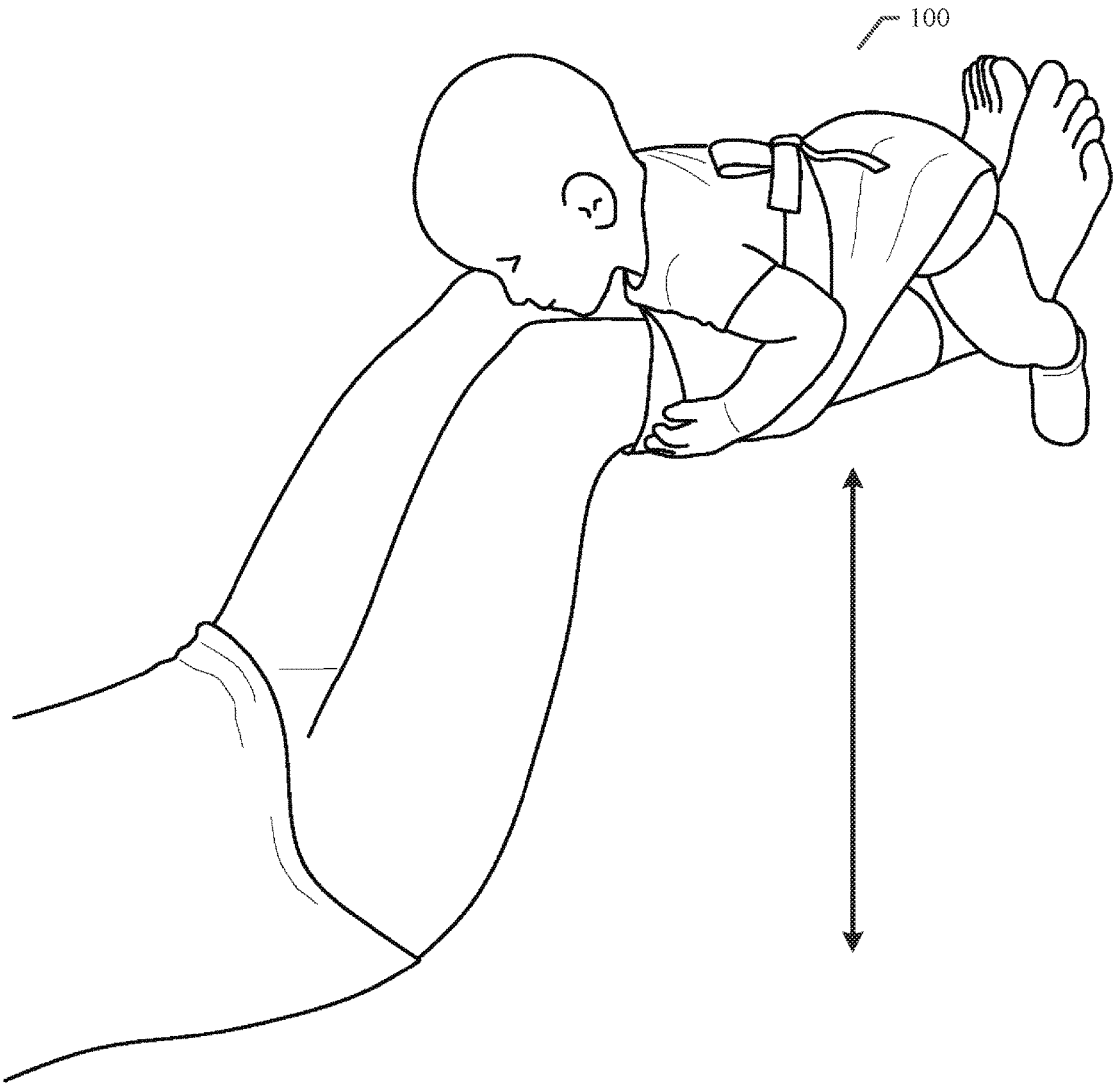
FIG. 9 illustrates an elevated view of a child securely wrapped in the leg-attachable child wrap with tied ends and attached to the legs of an adult in a head up (e.g., the child's head is toward or closest to the user/adult's head), prone position, thereby enabling the adult to exercise with the child according to an example embodiment.

FIG. 9 illustrates an elevated view of a child securely wrapped in the leg-attachable child wrap 100 with tied ends and attached to the legs of an adult in a head up (e.g., the child's head is toward or closest to the user/adult's head), prone position, thereby enabling the adult to exercise with the child according to an example embodiment. As described above, the example embodiments can be used to securely attach a child to the legs of a user. Once the child is securely attached, the adult/user can commence an exercise regimen with the child securely attached to the legs of the user as shown in FIG. 9. For example, the user can perform leg lifts as shown in FIG. 9 and represented by the double-arrow line. Similarly, the user can perform a variety of other exercises or routines including, sideways leg swings, knee bends, sit-ups, pull-ups, or a variety of other exercises or movements. In each case, the weight of the child on the legs of the user serves as resistance, which improves the efficiency of the exercise or movement relative to the muscle tone, skeletal alignment, and/or cardio-vascular conditioning of the user. Additionally, the movement of the user with the child attached to the legs of the user serves to entertain the child and engage the child in the activities of the user. As a result, the user can perform an exercise regimen and bond with the child at the same time. Moreover, the child can benefit from the fun and engaging movement of the adult/user.

Figure 10:
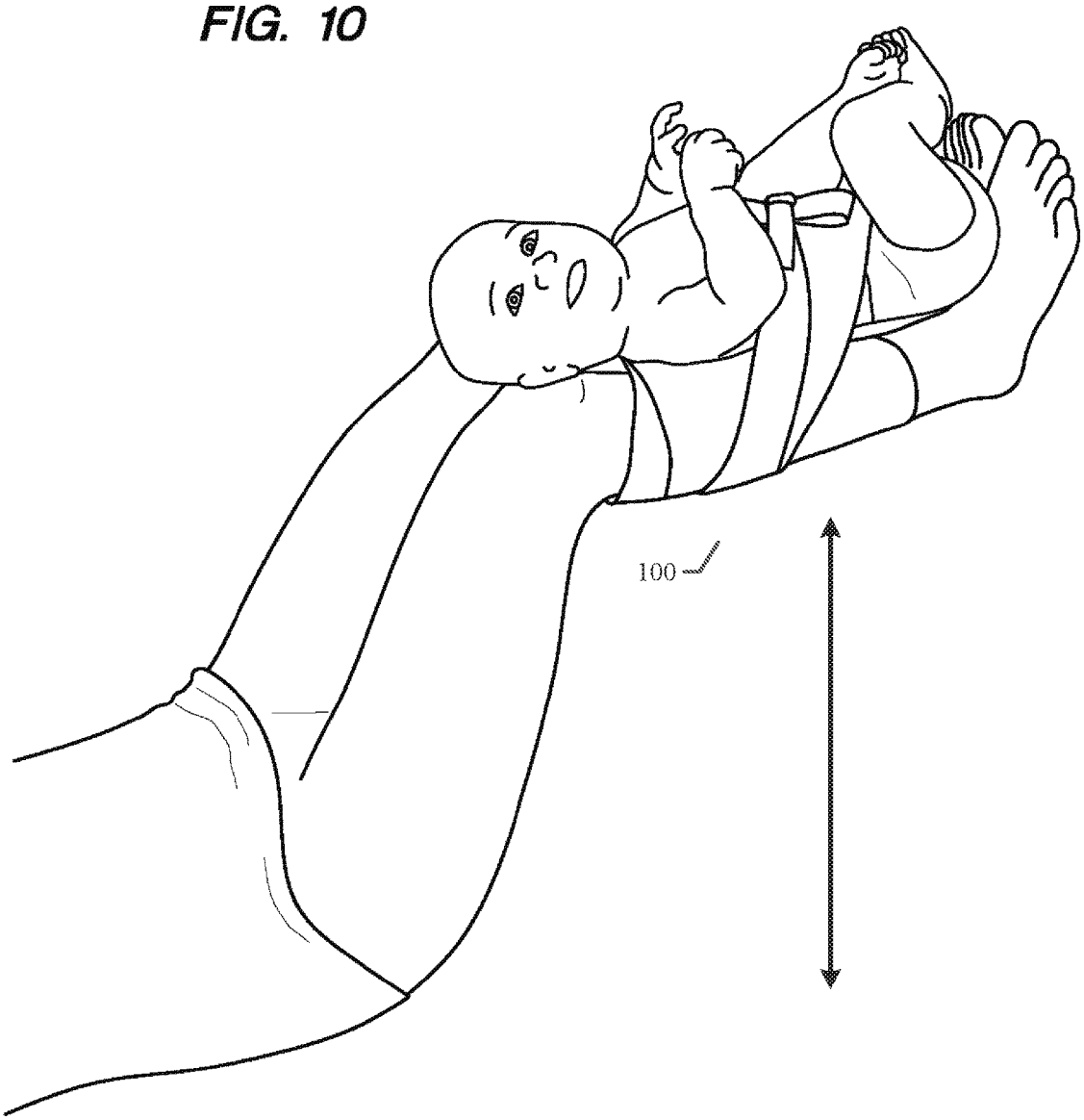
FIG. 10 illustrates an elevated view of a child securely wrapped in the leg-attachable child wrap with tied ends and attached to the legs of an adult in a head up (e.g., the child's head is toward or closest to the user/adult's head), supine position, thereby enabling the adult to exercise with the child according to an example embodiment.

FIG. 10 illustrates an elevated view of a child securely wrapped in the leg-attachable child wrap 100 with tied ends and attached to the legs of an adult in a head up (e.g., the child's head is toward or closest to the user/adult's head), supine position, thereby enabling the adult to exercise with the child according to an example embodiment. In various different ways of using the leg-attachable child wrap 100 of an example embodiment, the child can be positioned in or with the leg-attachable child wrap 100 in one of several ways depending on the wishes of the child and the adult/user. For example, as shown in FIG. 10, the child can be positioned in a head up (e.g., the child's head is toward or closest to the user/adult's head), supine position. As shown, the child is still securely attached to the legs of the adult/user by use of the leg-attachable child wrap 100. This position may be more enjoyable for the child as the child can look outwardly from the adult/user's legs.

Figure 11:
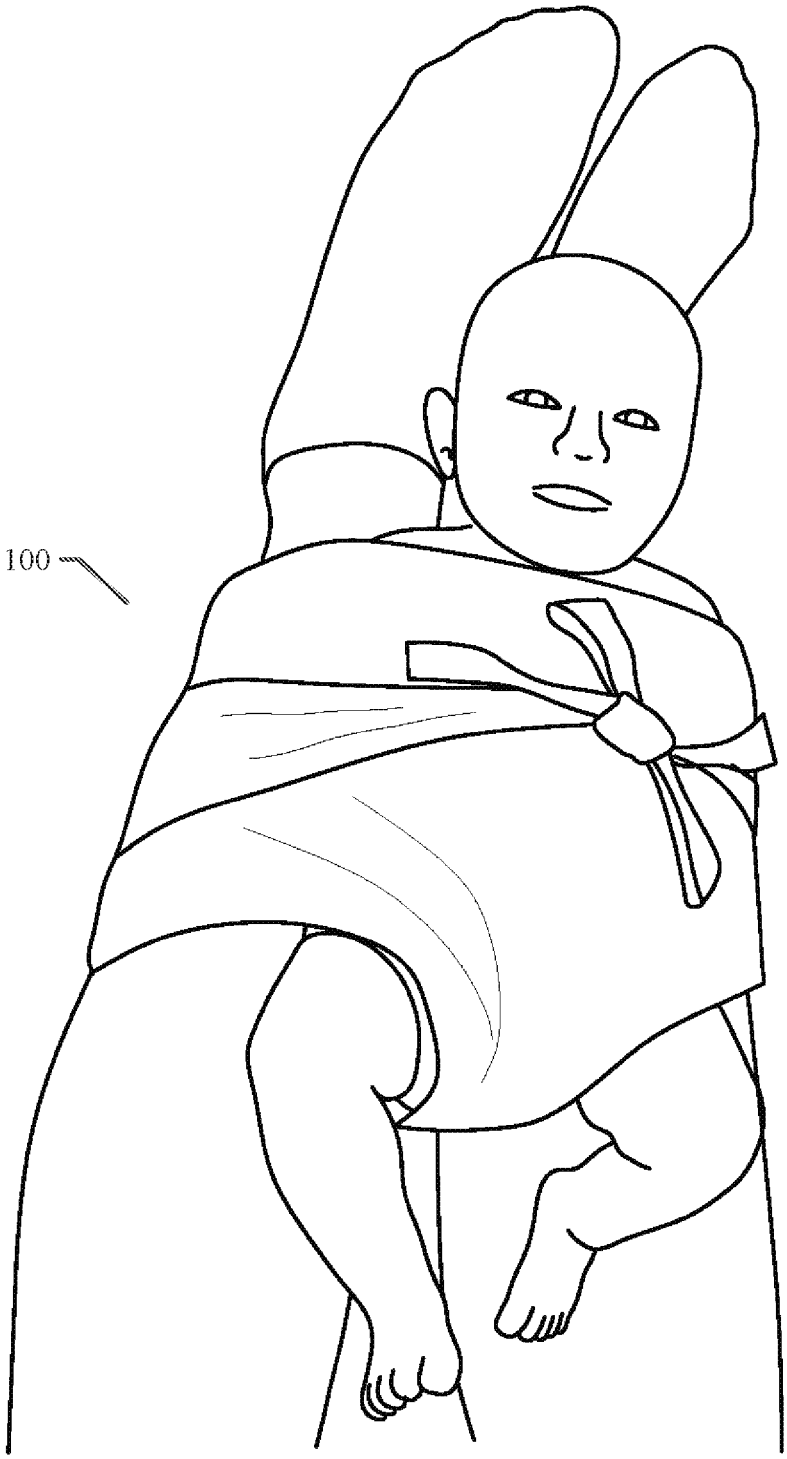
FIG. 11 illustrates an elevated view of a child securely wrapped in the leg-attachable child wrap with tied ends and attached to the legs of an adult in a head down (e.g., the child's head is toward or closest to the user/adult's feet), supine position, thereby enabling the adult to exercise with the child according to an example embodiment.

FIG. 11 illustrates an elevated view of a child securely wrapped in the leg-attachable child wrap 100 with tied ends and attached to the legs of an adult/user in a head down (e.g., the child's head is toward or closest to the user/adult's feet), supine position, thereby enabling the adult to exercise with the child according to an example embodiment. As shown, the child is securely attached to the legs of the adult/user by use of the leg-attachable child wrap 100. This position may be enjoyable for the child as the child can look outwardly from the adult/user's legs and see the face of the adult/user while the adult/user is exercising. Additionally, it will be apparent to those of ordinary skill in the art in view of the disclosure herein that the leg wrap portion 120 of the leg-attachable child wrap 100 can be attached to a single leg of the adult/user instead of both legs. Similarly, the leg wrap portion 120 of the leg-attachable child wrap 100 can be attached to the upper thighs of the adult/user instead of the lower portion of the legs. Thus, as shown and described for a variety of example embodiments, an adult/user can use the leg-attachable child wrap 100 with tied ends to securely attach a child to the legs of an adult/user, wherein the child can be positioned in one of several different ways.

Figure 12:
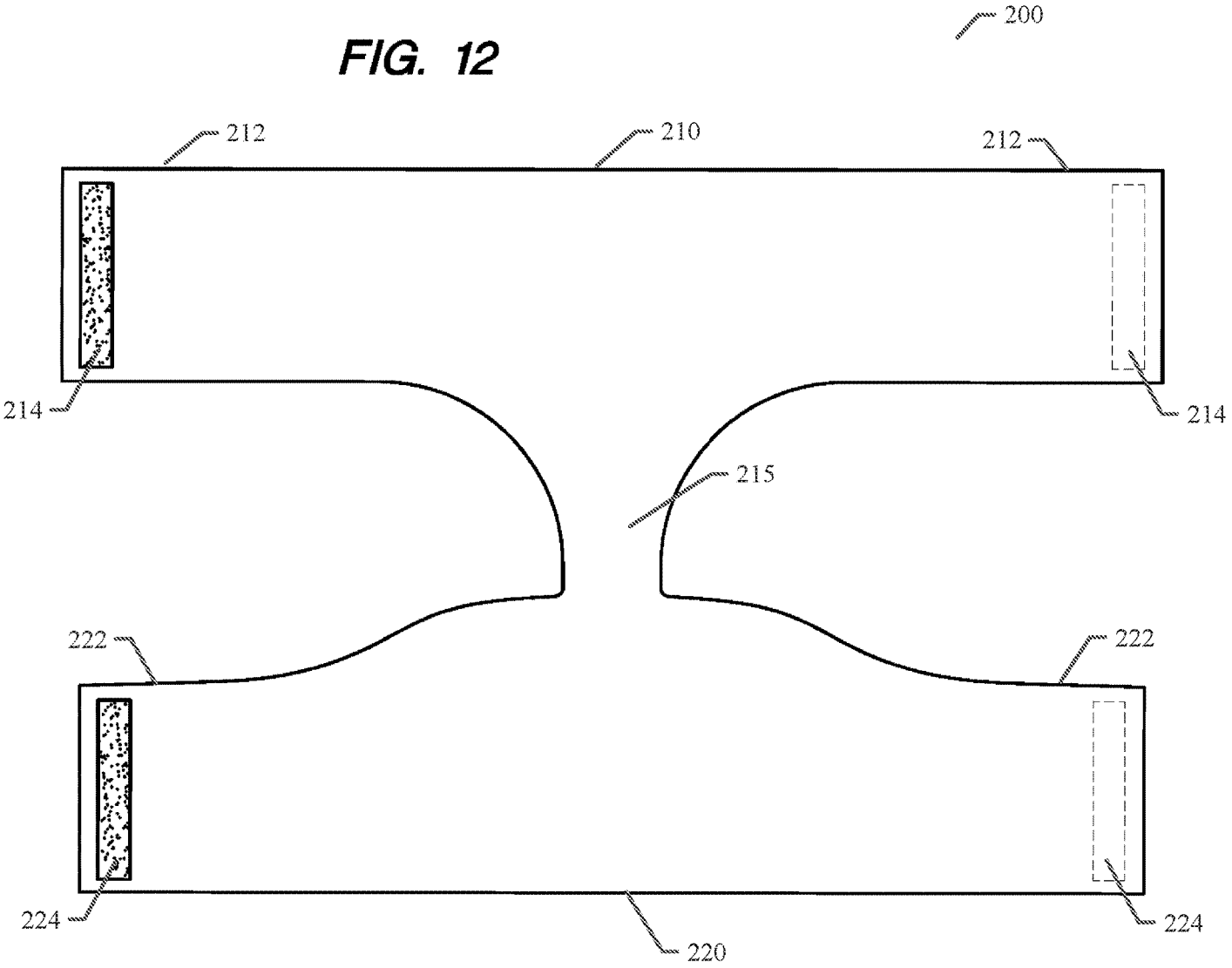
FIG. 12 illustrates a top plan view of a leg-attachable child wrap with fastened (e.g., hook and loop or Velcro™ strips) ends according to an example embodiment.

FIG. 12 illustrates a top plan view of a leg-attachable child wrap 200 with fastened (e.g., hook and loop or Velcro™ strips) ends according to an example embodiment. The illustrated example embodiment is shown to include a child wrap portion 210 having securing ends 212 that can be wrapped around and secure a child placed therebetween. The leg-attachable child wrap 200 further includes a leg wrap portion 220 having securing ends 222 that can be wrapped around and attached to the legs of a user. The leg-attachable child wrap 200 further includes a connecting portion 215 integrated between the child wrap portion 210 and the leg wrap portion 220. In an alternative embodiment, the connecting portion 215 can be detachable to enable connection or separation of the child wrap portion 210 to/from the leg wrap portion 220.

In the various example embodiments, the leg-attachable child wrap 200 can be manufactured from a variety of well-known materials or fabrics, such as cotton, synthetic materials, wool, canvas, plastic, Gortex™, linen, woven or knitted materials, rubber, and the like. Various example embodiments can be fabricated from materials with various characteristics including, water-resistant materials, waterproof materials, flame or fire retardant materials, non-allergenic materials, anti-bacterial materials, and the like. Additionally, the leg-attachable child wrap 200 can be manufactured from a variety of all natural fibers including plant and animal fibers—bamboo, silk, hemp, flax, ramie, mohair, camel hair, cashmere, angora wool, alpaca wool, and the like. All types of industrial manufacturing and handmade materials can also be used, including seamless, knitted, crocheted, woven, macrame, quilted, and sewn materials.

The example embodiment shown in FIG. 12 includes a child wrap portion 210 having securing ends 212 that can be wrapped around and releaseably fastened together to secure a child placed therebetween. In an example embodiment, the securing ends 212 can be releaseably fastened together with a releaseable fastener 214, such as a hook and loop fastener (e.g., Velcro™) In alternative embodiments, the releasable fastener 214 can be implemented as buckles, clips, ratchets, slide catches, buttons, or other means for securely attached securing ends 212 together. It will be apparent to those of ordinary skill in the art that the releaseable fastener 214 can be implemented in a variety of ways and used to securely attach the ends 212 to secure a child placed therebetween.

The example embodiment shown in FIG. 12 also includes a leg wrap portion 220 having securing ends 222 that can be wrapped around and attached to the legs of a user by use of releasable fasteners 224 (e.g., hook and loop or Velcro™ strips). In alternative embodiments, the releasable fasteners 224 can be implemented as buckles, clips, ratchets, slide catches, buttons, or other means for securely attached securing ends 222 together. It will be apparent to those of ordinary skill in the art that the outline shape of the child wrap portion 210 and the leg wrap portion 220 can vary somewhat as long as the child wrap portion 210 can wrap around and secure a child and the leg wrap portion 220 can wrap around and secure the legs of the user.

FIGS. 13 through 16, described in more detail below, illustrate a method for using the leg-attachable child wrap 200 with fastened ends as shown in FIG. 12. In general, the method involves three main processes: 1) attaching the leg wrap portion 220 to the legs of a user; 2) securing a child into the child wrap portion 210; and commencing an exercise regimen with the child securely attached to the legs of the user. These general processes of an example embodiment are described in more detail below.

Figure 13:
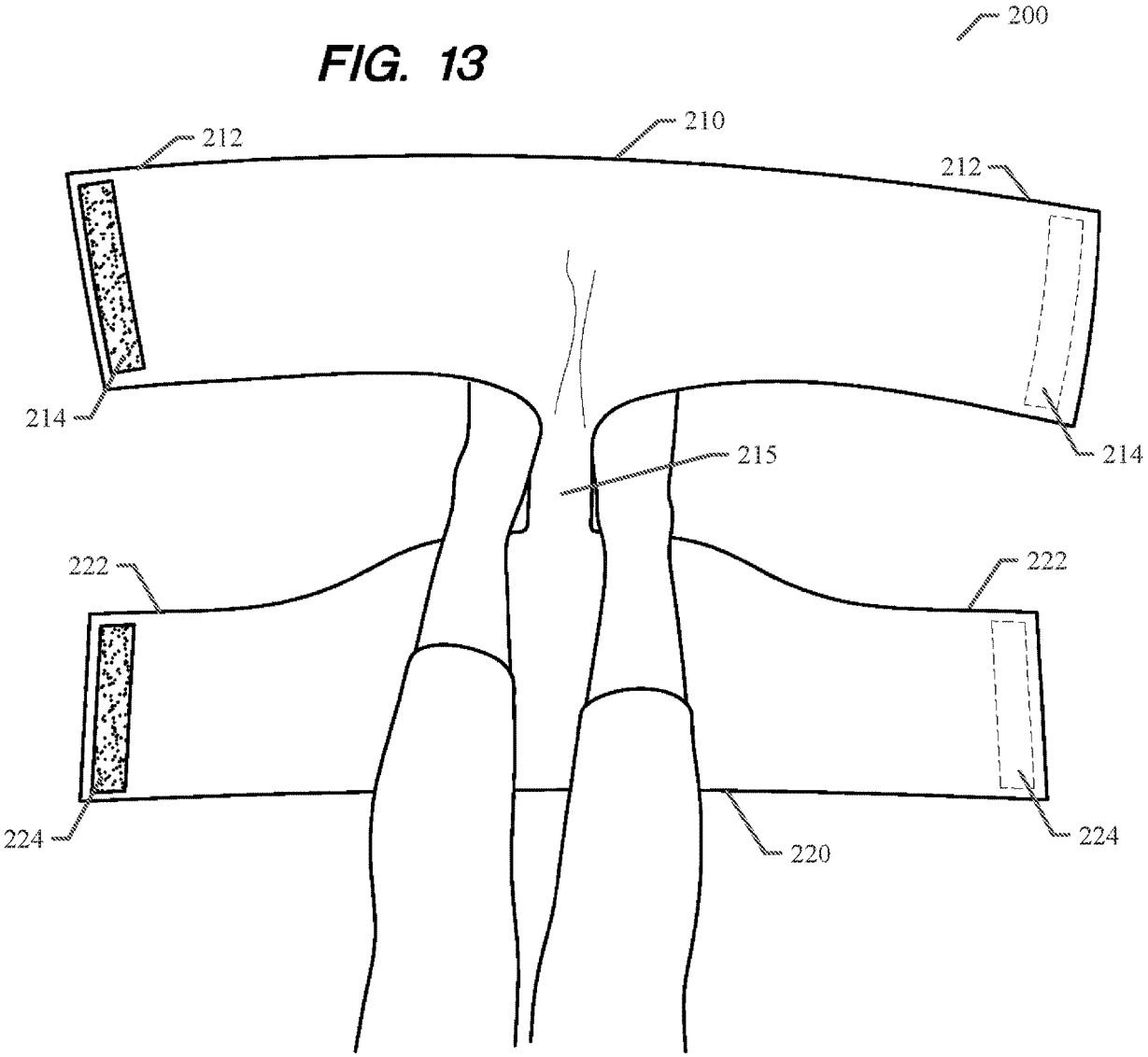
FIG. 13 illustrates a top plan view of the leg-attachable child wrap with fastened ends showing the placement of the adult's legs relative to a connecting portion according to an example embodiment.

FIG. 13 illustrates a top plan view of the leg-attachable child wrap 200 with fastened ends showing the placement of the adult's or user's legs relative to a connecting portion 215 according to an example embodiment. Initially, the user can position his/her legs so the legs straddle the connecting portion 215 near the lower portion of the legs as shown. The legs can be positioned on top of the leg wrap portion 220 and underneath the child wrap portion 210.

Figure 14:
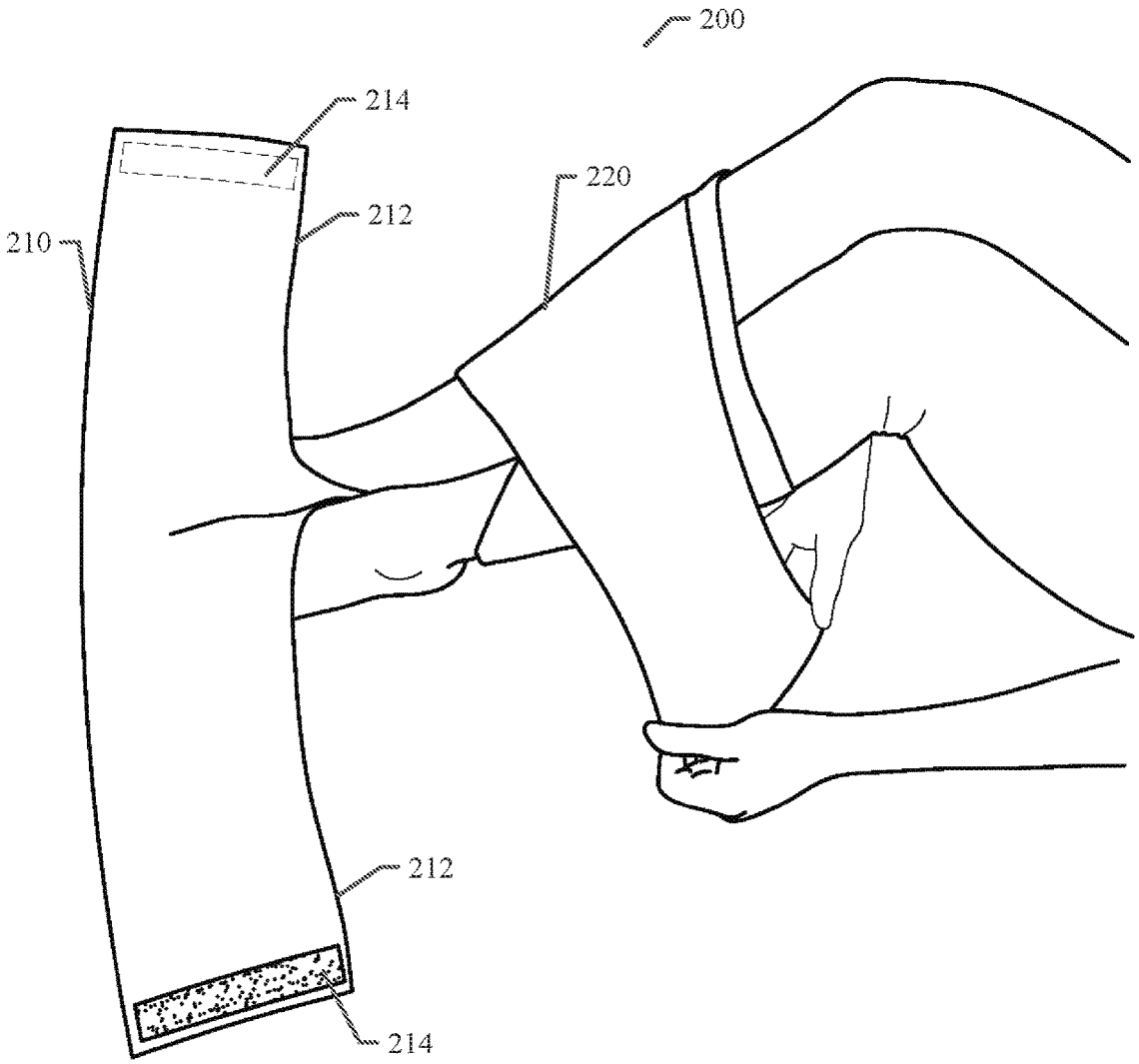
FIG. 14 illustrates an elevated view of the leg-attachable child wrap with fastened ends showing the wrapping of the adult's legs with a leg wrap portion according to an example embodiment.

FIG. 14 illustrates a view of the leg-attachable child wrap 200 with fastened ends showing the wrapping of the adult's legs with a leg wrap portion 220 according to an example embodiment. The user's legs can be wrapped tightly and securely with the leg wrap portion 220 and the securing ends 222 can be attached with the releasable fasteners 224. As a result, the leg-attachable child wrap 200 is securely attached to the legs of the user. In an alternative embodiment, the leg wrap portion 220 can be securely held in place using a separate mechanism, such as a belt, tie wrap, or other separate securing means.

Figure 15:
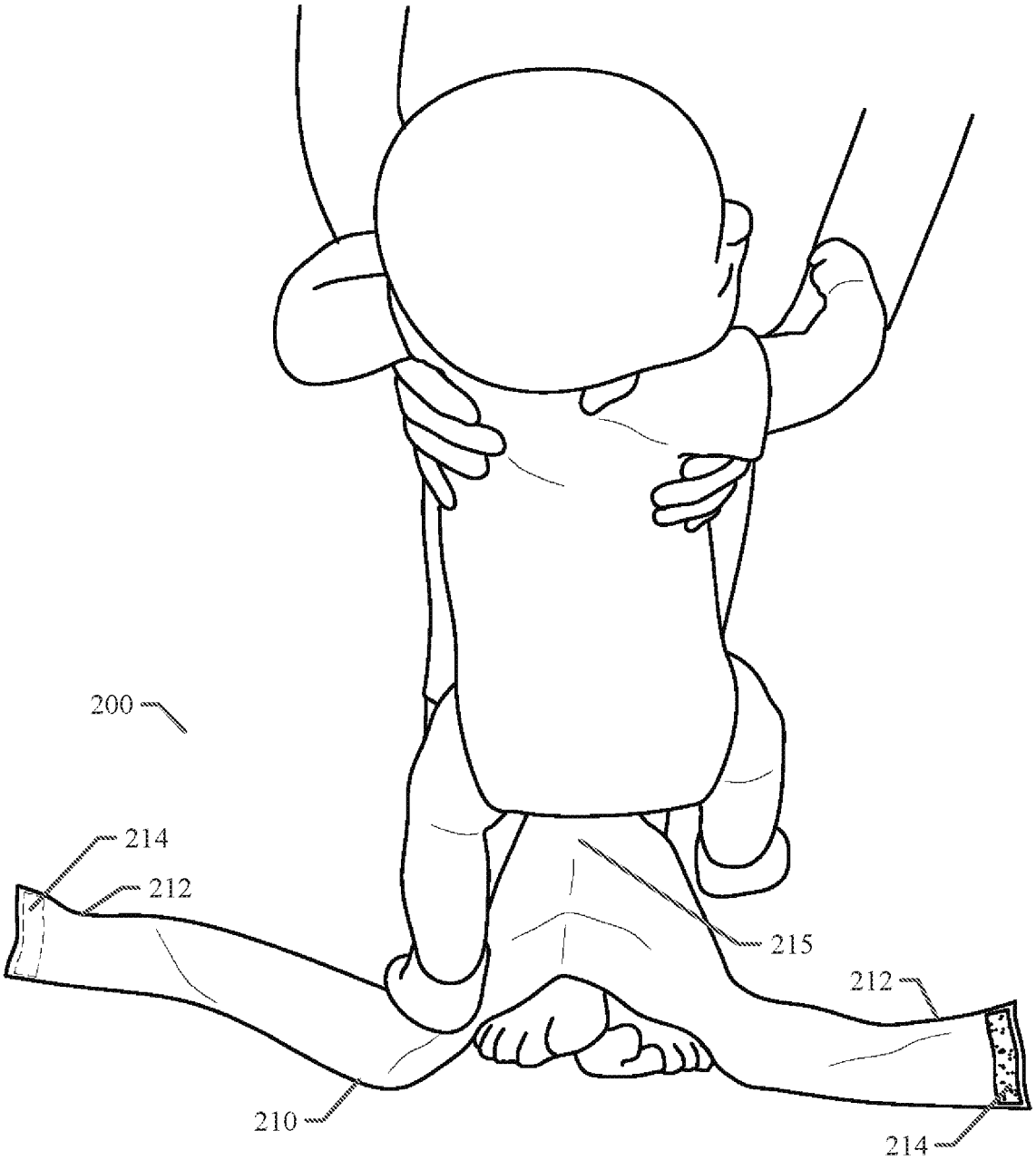
FIG. 15 illustrates an elevated view of the leg-attachable child wrap with fastened ends showing the placement of a child relative to the connecting portion according to an example embodiment.

FIG. 15 illustrates an elevated view of the leg-attachable child wrap 200 with fastened ends showing the placement of a child relative to the connecting portion 215 according to an example embodiment. Once the user's legs are wrapped tightly and securely with the leg wrap portion 220 as described above, a child can be positioned so the legs of the child straddle the connecting portion 215 as shown. The body of the child can be positioned on top of the user's lower legs and on top of the leg wrap portion 220. The body of the child can be positioned so a part of the child wrap portion 210 can be pulled between the child's legs. In the example embodiment, the child can be positioned in a variety of ways depending on the wishes of the child and the adult/user. For example, as described in more detail below, the child can be positioned in several ways, including: 1) in a head up (e.g., the child's head is toward or closest to the user/adult's head), prone position; 2) in a head up (e.g., the child's head is toward or closest to the user/adult's head), supine position; 3) in a head down (e.g., the child's head is toward or closest to the user/adult's feet), prone position; or 4) in a head down (e.g., the child's head is toward or closest to the user/adult's feet), supine position. In each case, the various embodiments described herein support the child as securely attached to the legs of the user.

Figure 16:
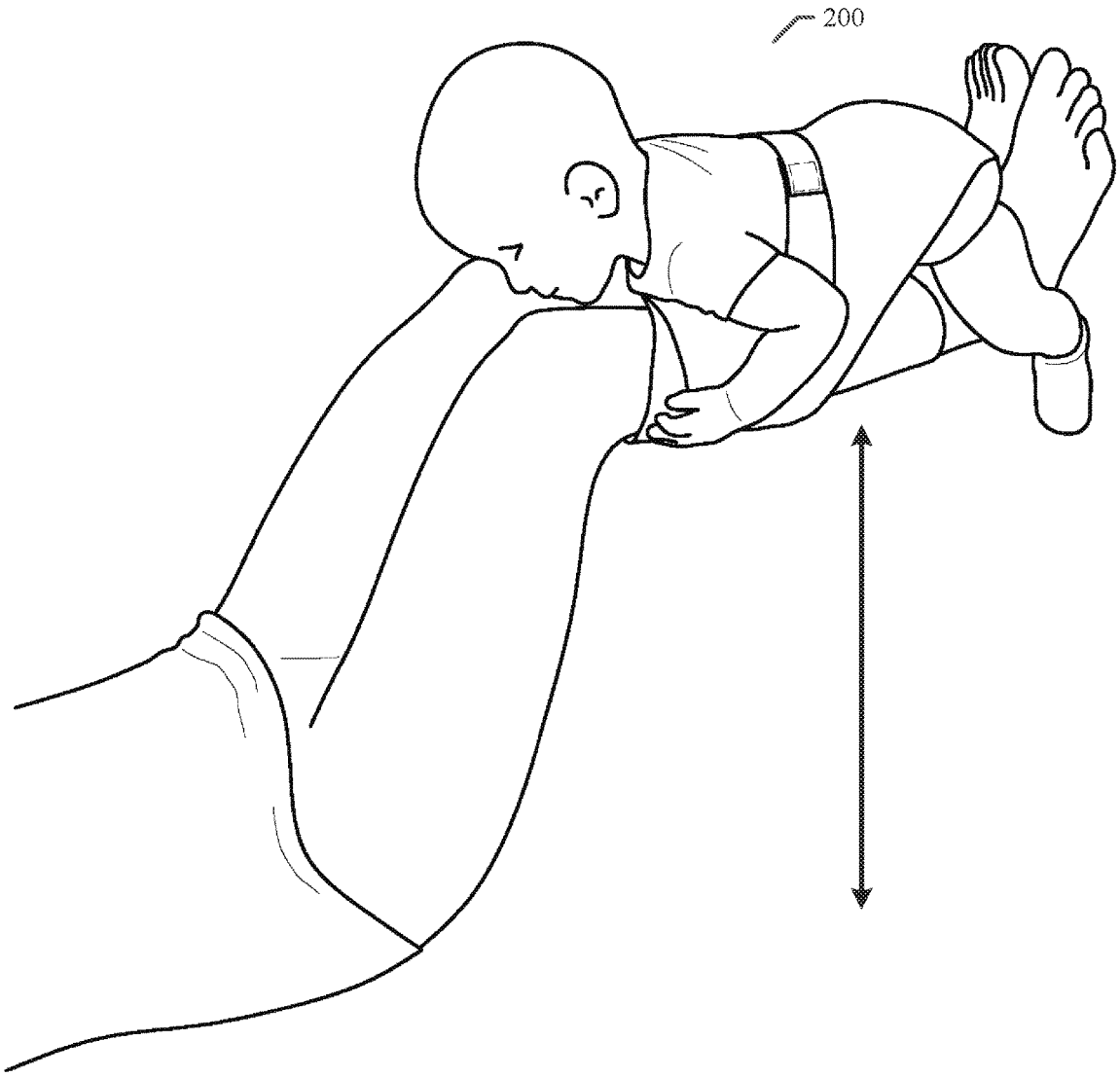
FIG. 16 illustrates an elevated view of a child securely wrapped in the leg-attachable child wrap with fastened ends and attached to the legs of an adult in a head up (e.g., the child's head is toward or closest to the user/adult's head), prone position, thereby enabling the adult to exercise with the child according to an example embodiment.

Once the body of the child is positioned on top of the user's lower legs and on top of the leg wrap portion 220 as shown in FIG. 15, a part of the child wrap portion 210 can be pulled between the child's legs. Then, the securing ends 212 of the child wrap portion 210 can be wrapped around the child and fastened together as shown in FIG. 16. As a result, the child is securely attached to the legs of the user.

FIG. 16 illustrates an elevated view of a child securely wrapped in the leg-attachable child wrap 200 with fastened ends and attached to the legs of an adult in a head up (e.g., the child's head is toward or closest to the user/adult's head), prone position, thereby enabling the adult to exercise with the child according to an example embodiment. As described above, the example embodiments can be used to securely attach a child to the legs of a user. Once the child is securely attached, the adult/user can commence an exercise regimen with the child securely attached to the legs of the user as shown in FIG. 16. For example, the user can perform leg lifts as shown in FIG. 16 and represented by the double-arrow line. Similarly, the user can perform a variety of other exercises or routines including, sideways leg swings, knee bends, sit-ups, pull-ups, or a variety of other exercises or movements. In each case, the weight of the child on the legs of the user serves as resistance, which improves the efficiency of the exercise or movement relative to the muscle tone, skeletal alignment, and/or cardio-vascular conditioning of the user. Additionally, the movement of the user with the child attached to the legs of the user serves to entertain the child and engage the child in the activities of the user. As a result, the user can perform an exercise regimen and bond with the child at the same time. Moreover, the child can benefit from the fun and engaging movement of the adult/user.

As described above, the child can be positioned in the leg-attachable child wrap 200 in one of several ways depending on the wishes of the child and the adult/user. For example, as shown in FIG. 16, the child can be positioned in a head up (e.g., the child's head is toward or closest to the user/adult's head), prone position. As shown, the child is securely attached to the legs of the adult/user by use of the leg-attachable child wrap 200. Alternatively, the child can be securely wrapped in the leg-attachable child wrap 200 with fastened ends and attached to the legs of an adult/user in a head up (e.g., the child's head is toward or closest to the user/adult's head), supine position, thereby enabling the adult to exercise with the child according to an example embodiment. This position may be enjoyable for the child as the child can look outwardly from the adult/user's legs. As another alternative provided by the example embodiments, the child can be securely wrapped in the leg-attachable child wrap 200 with fastened ends and attached to the legs of an adult/user in a head down (e.g., the child's head is toward or closest to the user/adult's feet), prone position, thereby enabling the adult to exercise with the child according to an example embodiment. As another alternative provided by the example embodiments, the child can be securely wrapped in the leg-attachable child wrap 200 with fastened ends and attached to the legs of an adult/user in a head down (e.g., the child's head is toward or closest to the user/adult's feet), supine position, thereby enabling the adult to exercise with the child according to an example embodiment. This position may be more enjoyable for the child as the child can look outwardly from the adult/user's legs and see the face of the adult/user as the adult/user is exercising. Additionally, it will be apparent to those of ordinary skill in the art in view of the disclosure herein that the leg wrap portion 220 of the leg-attachable child wrap 200 can be attached to a single leg of the adult/user instead of both legs. Similarly, the leg wrap portion 220 of the leg-attachable child wrap 200 can be attached to the upper thighs of the adult/user instead of the lower portion of the legs.

Thus, as shown and described for a variety of example embodiments, an adult/user can use the leg-attachable child wrap 200 with fastened ends to securely attach a child to the legs of an adult/user, wherein the child can be positioned in one of several different ways. As a result, the adult/user can commence an exercise regimen while the child is attached to the legs of the adult/user.

Figure 17:
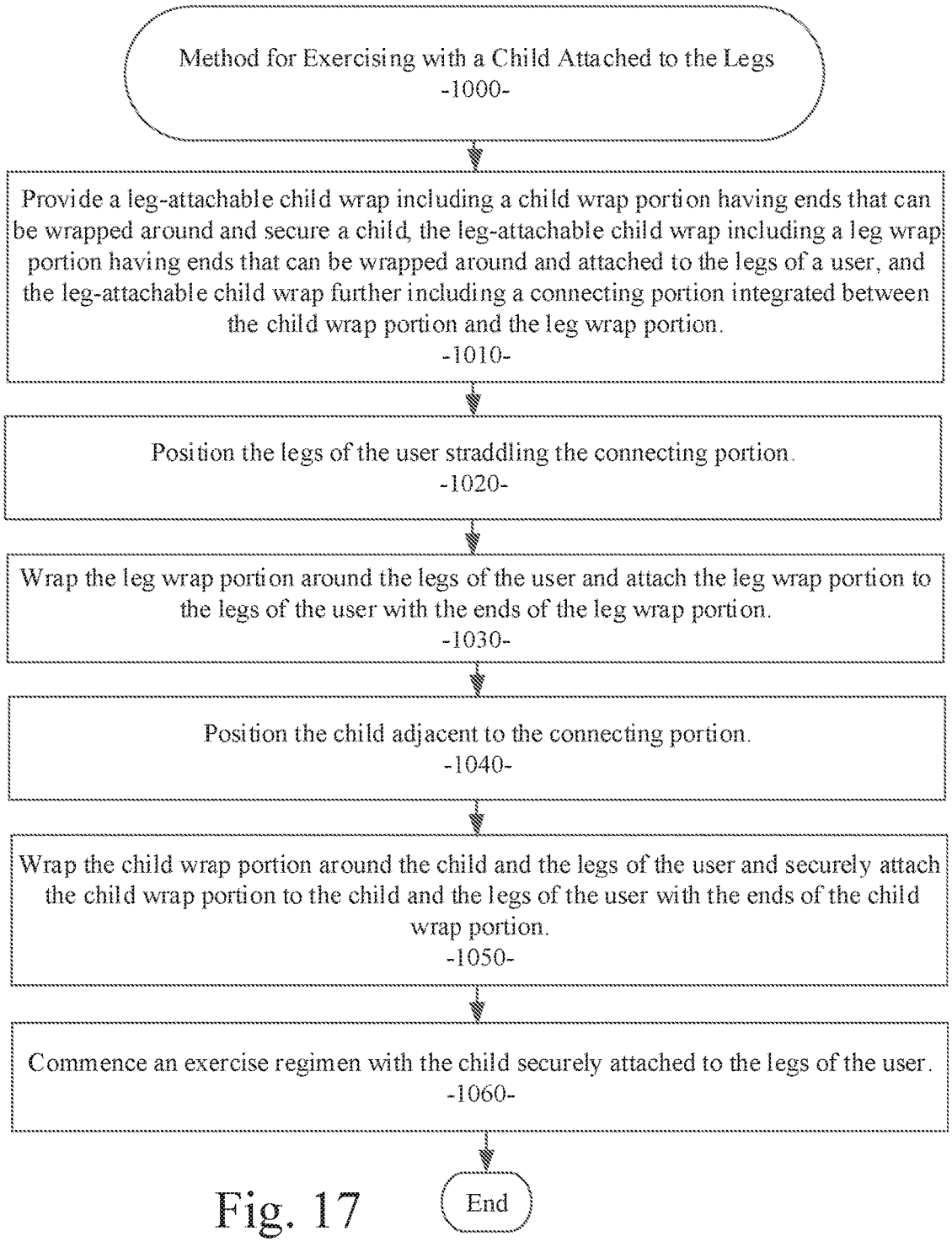
FIG. 17 illustrates a flow diagram representing a sequence of operations performed in a method according to an example embodiment.

FIG. 17 illustrates a flow diagram representing a sequence of operations performed in a method according to an example embodiment. In accordance with the example method 1000, the method comprises: providing a leg-attachable child wrap including a child wrap portion having ends that can be wrapped around and secure a child, the leg-attachable child wrap including a leg wrap portion having ends that can be wrapped around and attached to the legs of a user, and the leg-attachable child wrap further including a connecting portion integrated between the child wrap portion and the leg wrap portion (operation 1010); positioning the legs of the user straddling the connecting portion (operation 1020); wrapping the leg wrap portion around the legs of the user and attaching the leg wrap portion to the legs of the user with the ends of the leg wrap portion (operation 1030); positioning the child adjacent to the connecting portion (operation 1040); wrapping the child wrap portion around the child and the legs of the user and securely attaching the child wrap portion to the child and the legs of the user with the ends of the child wrap portion (operation 1050); and commencing an exercise regimen with the child securely attached to the legs of the user (operation 1060).

Figure 18:
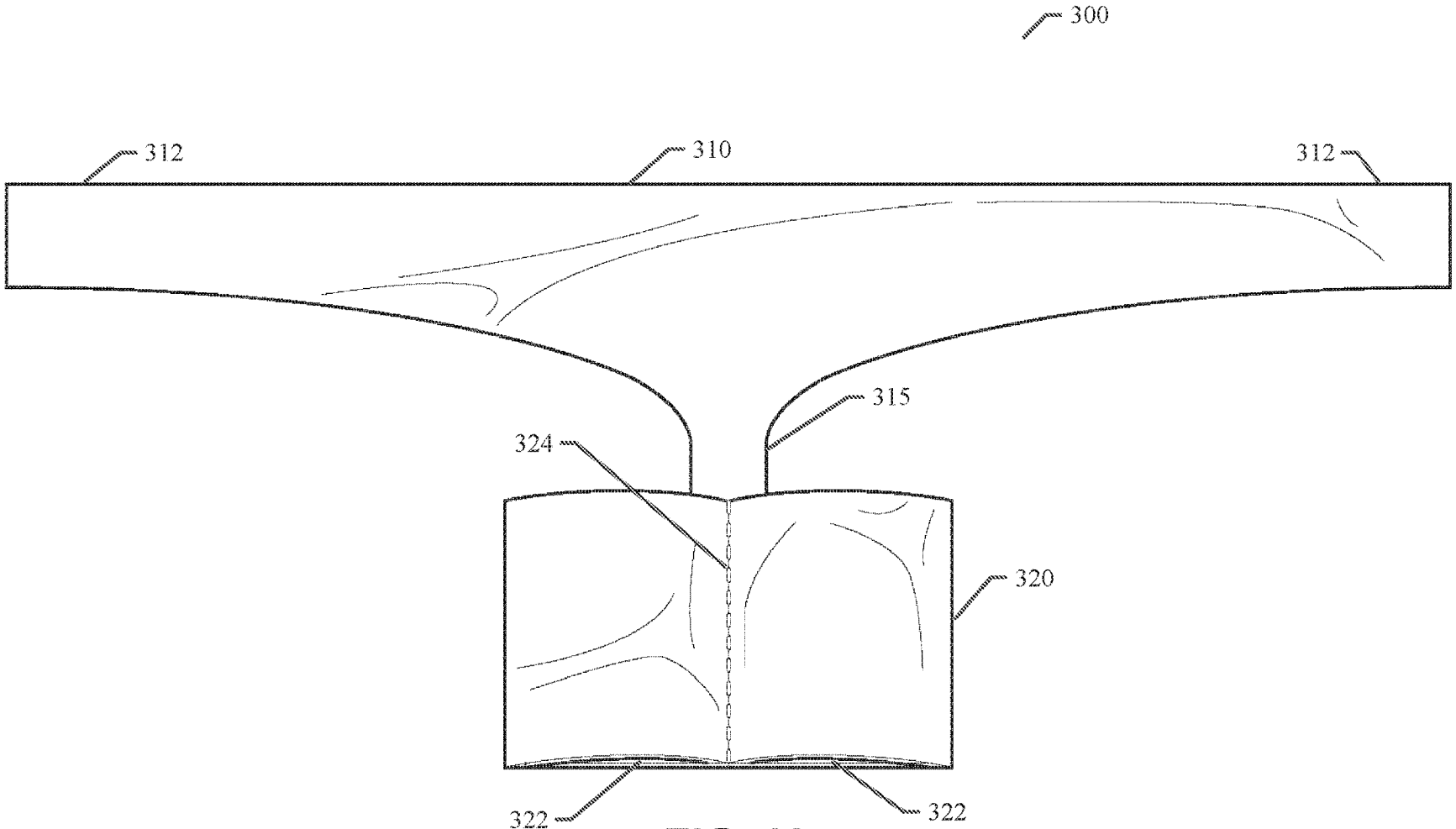
FIG. 18 illustrates a top plan view of a leg-attachable child wrap with a double looped leg wrap portion according to an example embodiment.

FIG. 18 illustrates a top plan view of a leg-attachable child wrap 300 with a double looped leg wrap portion 320 according to an example embodiment. The illustrated example embodiment is shown to include a child wrap portion 310 having securing ends 312 that can be wrapped around and secure a child placed therebetween. The leg-attachable child wrap 300 further includes the double looped leg wrap portion 320 having two open loops 322, one loop for each leg of an adult wearer. The double looped leg wrap portion 320 can be fabricated from a continuous loop of material that is stitched down the middle at seam 324 to create the two open loops 322. As a result, the double looped leg wrap portion 320 does not require tied or attachable ends. The double looped leg wrap portion 320 can be fabricated from any type of material as described above. In a particular embodiment, the double looped leg wrap portion 320 can be fabricated from an elastic or stretchable material is to provide better adhesion to the legs of an adult wearer/user. Each leg of the adult wearer/user can be inserted through a different one of the two open loops 322 thereby attaching or securing the double looped leg wrap portion 320 to the legs of the adult wearer/user. The leg-attachable child wrap 300 further includes a connecting portion 315 integrated between the child wrap portion 310 and the leg wrap portion 320. In an alternative embodiment, the connecting portion 315 can be detachable to enable connection or separation of the child wrap portion 310 to/from the leg wrap portion 320 as described in more detail below.

Figure 19:
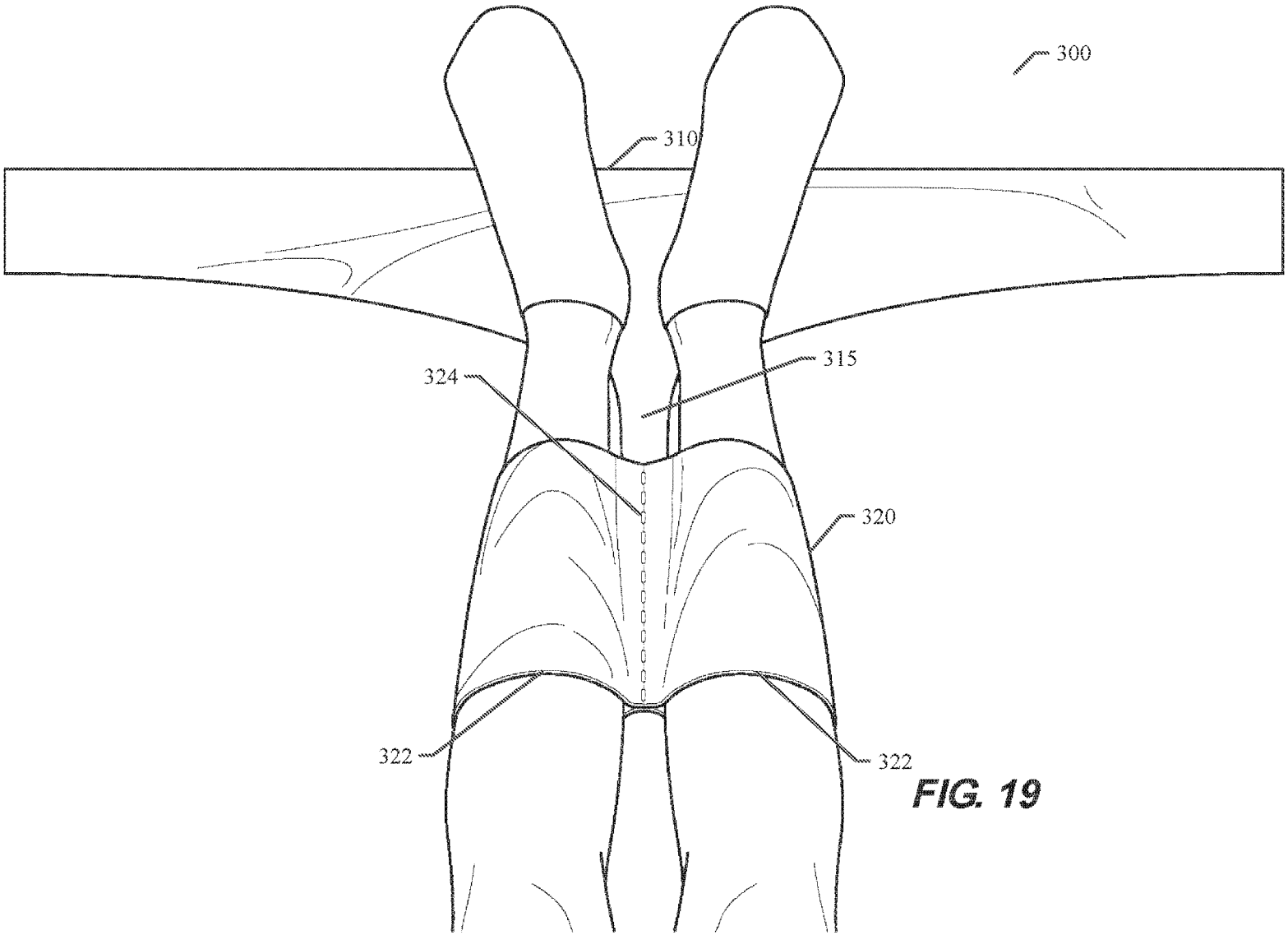
FIG. 19 illustrates an elevated view of the leg-attachable child wrap with a double looped leg wrap portion showing the placement of each of the adult's legs through a different one of the double loops and relative to a connecting portion according to an example embodiment.

FIG. 19 illustrates an elevated view of the leg-attachable child wrap 300 with a double looped leg wrap portion 320 showing the placement of each of the adult's legs through a different one of the double loops 322 and relative to the connecting portion 315 and the child wrap portion 310 according to an example embodiment.

Figure 20:
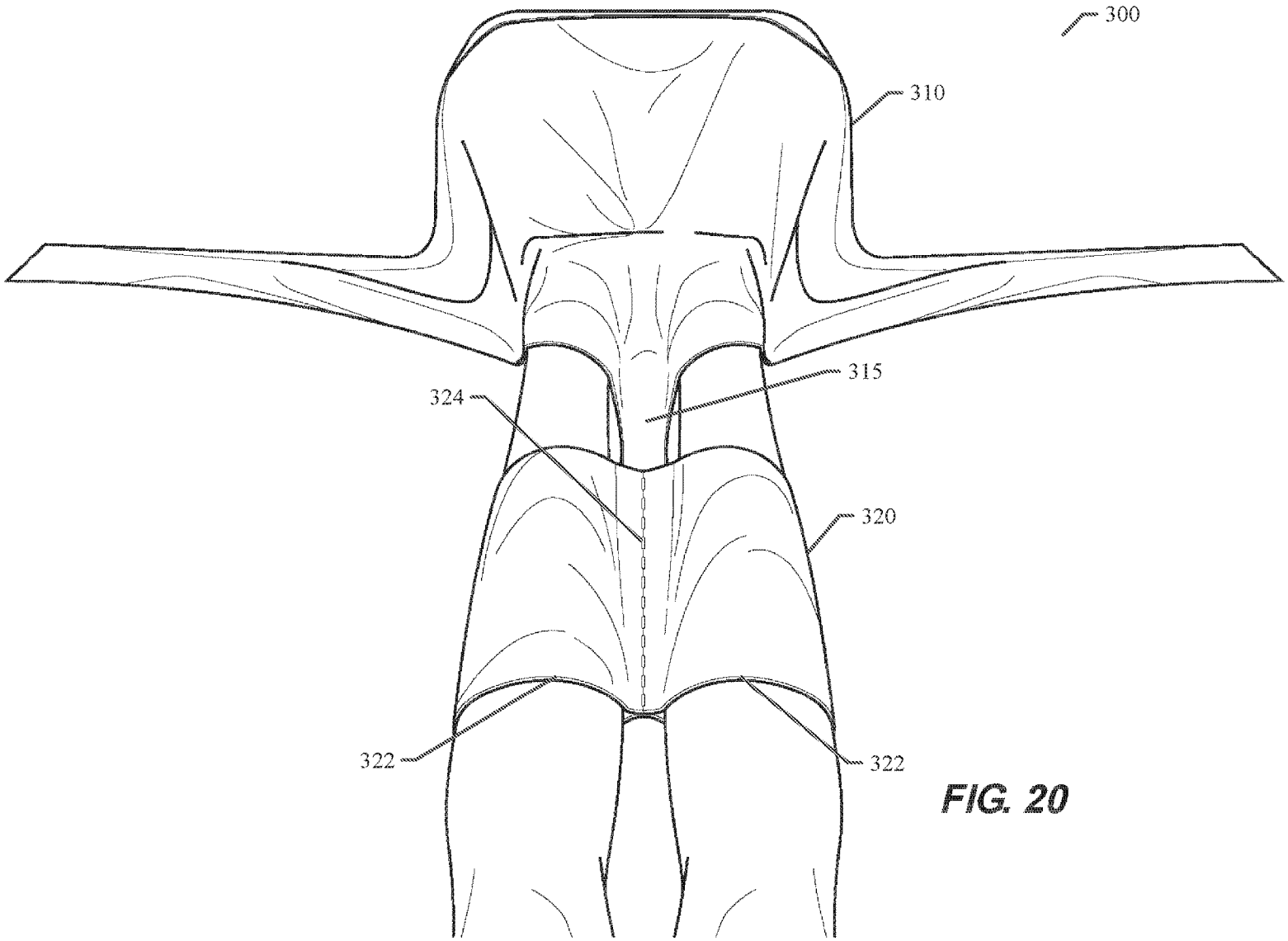
FIG. 20 illustrates an elevated view of the leg-attachable child wrap with a double looped leg wrap portion attached to the legs of an adult through each of the double loops and showing the positioning of the child wrap portion as ready to receive the placement of a child in the child wrap portion according to an example embodiment.

FIG. 20 illustrates an elevated view of the leg-attachable child wrap 300 with a double looped leg wrap portion 320 attached to the legs of an adult through each of the double loops 322 and showing the positioning of the child wrap portion 310 as ready to receive the placement of a child in the child wrap portion 310 according to an example embodiment.

Figure 21:
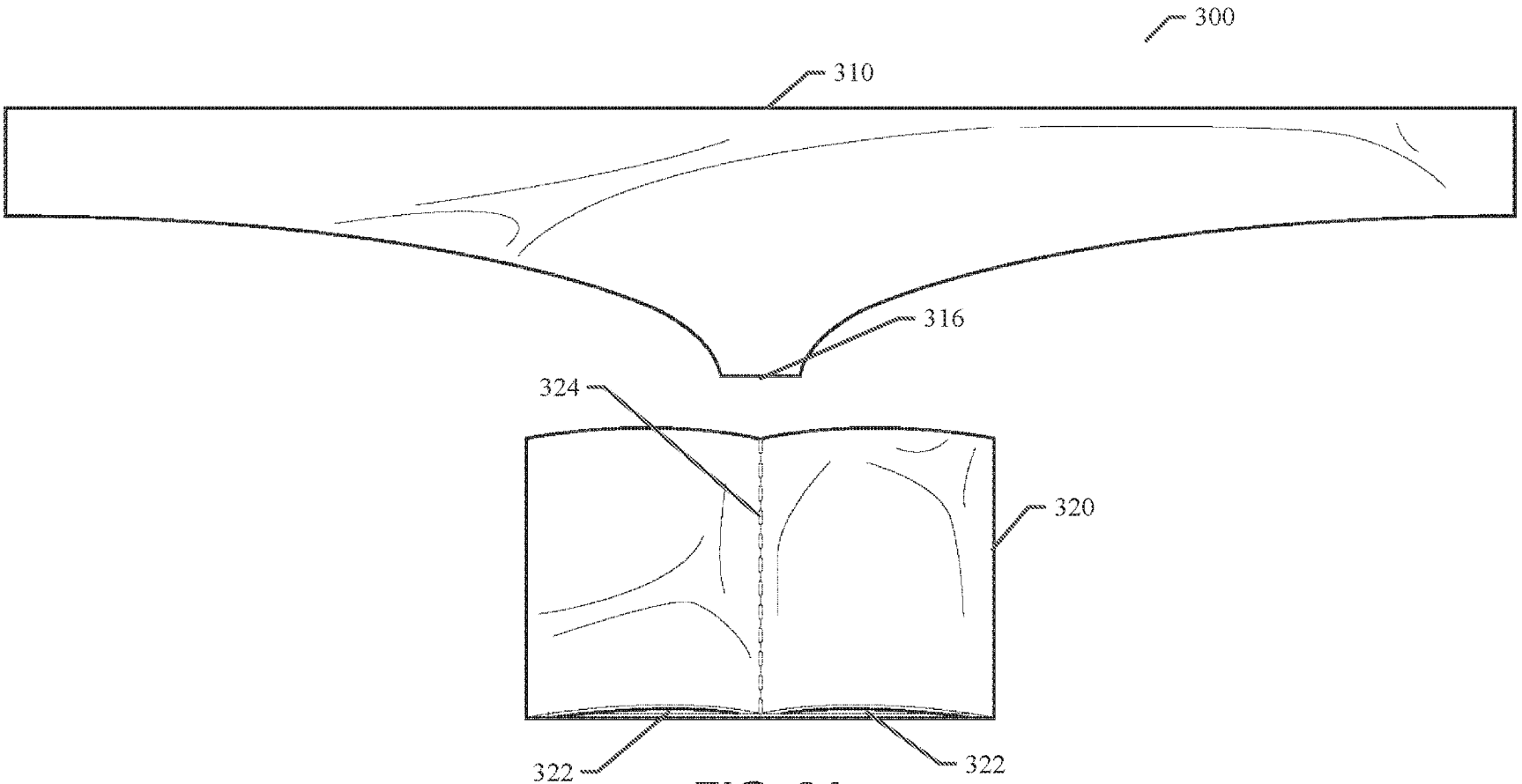
FIG. 21 illustrates a top plan view of a leg-attachable child wrap with a double looped leg wrap portion showing a detachable connecting portion according to an example embodiment.

FIG. 21 illustrates a top plan view of a leg-attachable child wrap 300 with a double looped leg wrap portion 320 showing a detachable connecting portion 316 according to an example embodiment. In the example embodiment, the connecting portion 316 can be detachable to enable connection or separation of the child wrap portion 310 to/from the leg wrap portion 320. The detachable connecting portion 316 can be implemented with snaps, hook and loop (Velcro™) strips, zipper, buttons, or other detachable connection means. The detachable connecting portion 316 enables the customization of the leg-attachable child wrap 300 so that different sizes or colors of child wrap portions 310 can be used with different sizes or colors of leg wrap portions 320.

Figure 22:
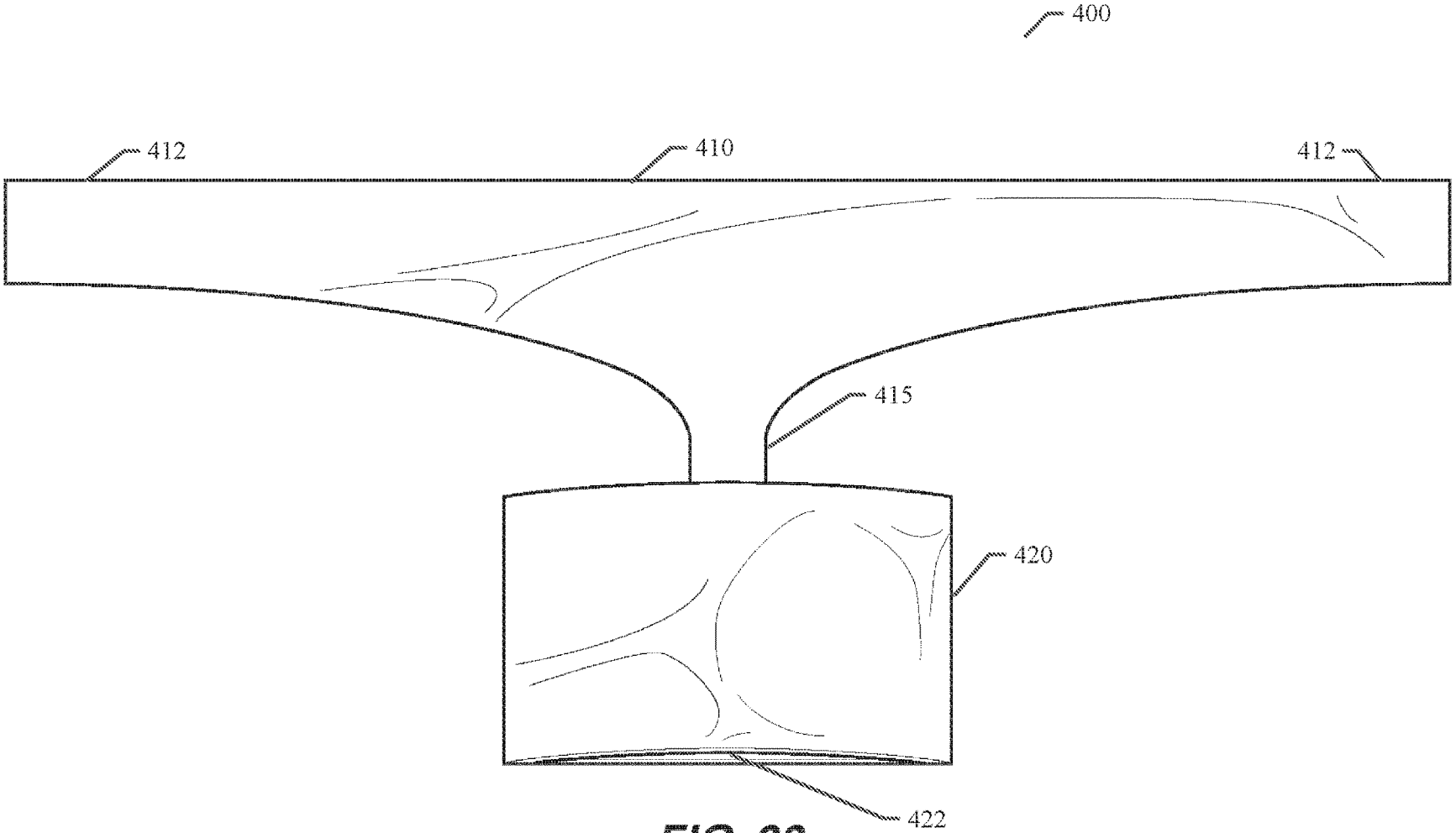
FIG. 22 illustrates a top plan view of a leg-attachable child wrap with a single loop leg wrap portion according to an example embodiment.

FIG. 22 illustrates a top plan view of a leg-attachable child wrap 400 with a single loop leg wrap portion 420 according to an example embodiment. The illustrated example embodiment is shown to include a child wrap portion 410 having securing ends 412 that can be wrapped around and secure a child placed therebetween. The leg-attachable child wrap 400 further includes the single loop leg wrap portion 420 having one open loop 422, one loop for both legs of an adult wearer. The single loop leg wrap portion 420 can be fabricated from a continuous loop of material. Note that in this embodiment, there is no stitch down the middle of the open loop 420 and thus no seam to accommodate both legs of the adult wearer/user. Because the single loop leg wrap portion 420 is a continuous loop of material, the single loop leg wrap portion 420 does not require tied or attachable ends. The single loop leg wrap portion 420 can be fabricated from any type of material as described above. In a particular embodiment, the single loop leg wrap portion 420 can be fabricated from an elastic or stretchable material is to provide better adhesion to the legs of an adult wearer/user. Both legs of the adult wearer/user can be inserted through the single open loop 422 thereby attaching or securing the single loop leg wrap portion 420 to the legs of the adult wearer/user. The leg-attachable child wrap 400 further includes a connecting portion 415 integrated between the child wrap portion 410 and the leg wrap portion 420. In an alternative embodiment, the connecting portion 415 can be detachable to enable connection or separation of the child wrap portion 410 to/from the leg wrap portion 420 as described in more detail below.

Figure 23:
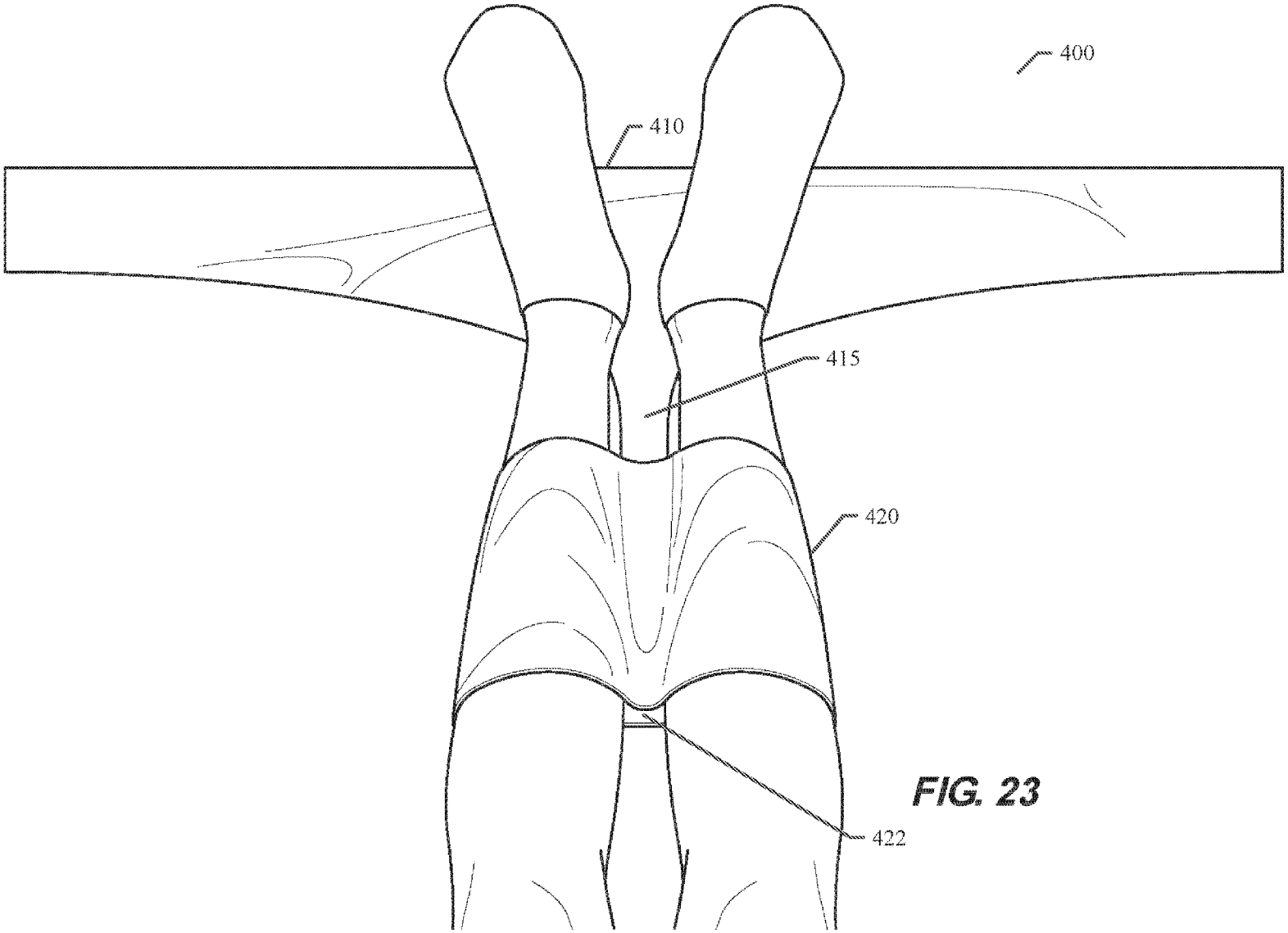
FIG. 23 illustrates an elevated view of the leg-attachable child wrap with a single loop leg wrap portion showing the placement of both of the adult's legs through the single loop and relative to a connecting portion according to an example embodiment.

FIG. 23 illustrates an elevated view of the leg-attachable child wrap 400 with a single loop leg wrap portion 420 showing the placement of both of the adult's legs through the single loop 422 and relative to a connecting portion 415 and the child wrap portion 410 according to an example embodiment.

Figure 24:
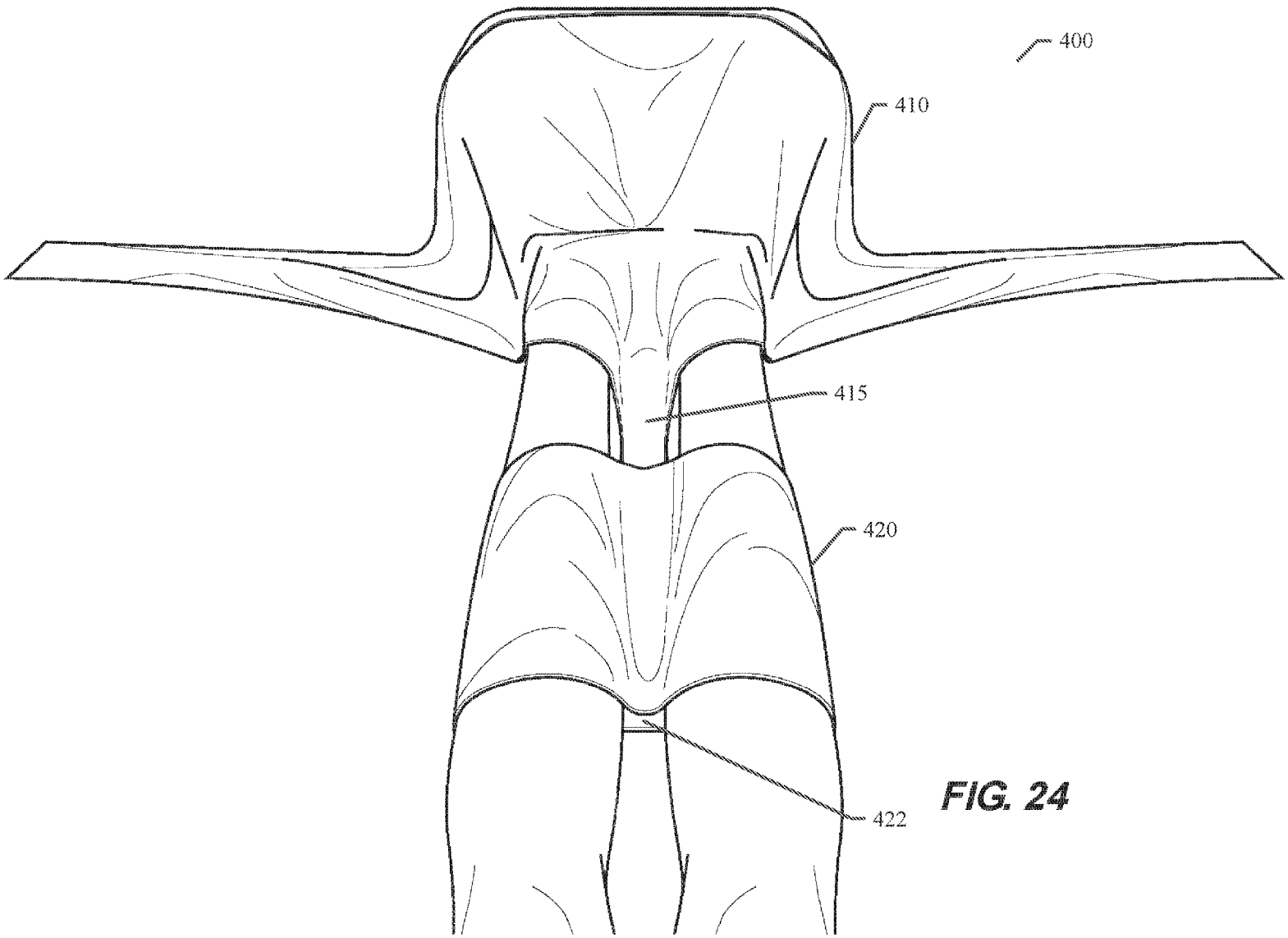
FIG. 24 illustrates an elevated view of the leg-attachable child wrap with a single loop leg wrap portion attached to the legs of an adult through the single loop and showing the positioning of the child wrap portion as ready to receive the placement of a child in the child wrap portion according to an example embodiment.

FIG. 24 illustrates an elevated view of the leg-attachable child wrap 400 with a single loop leg wrap portion 420 attached to the legs of an adult through the single loop 422 and showing the positioning of the child wrap portion 410 as ready to receive the placement of a child in the child wrap portion 410 according to an example embodiment.

Figure 25:
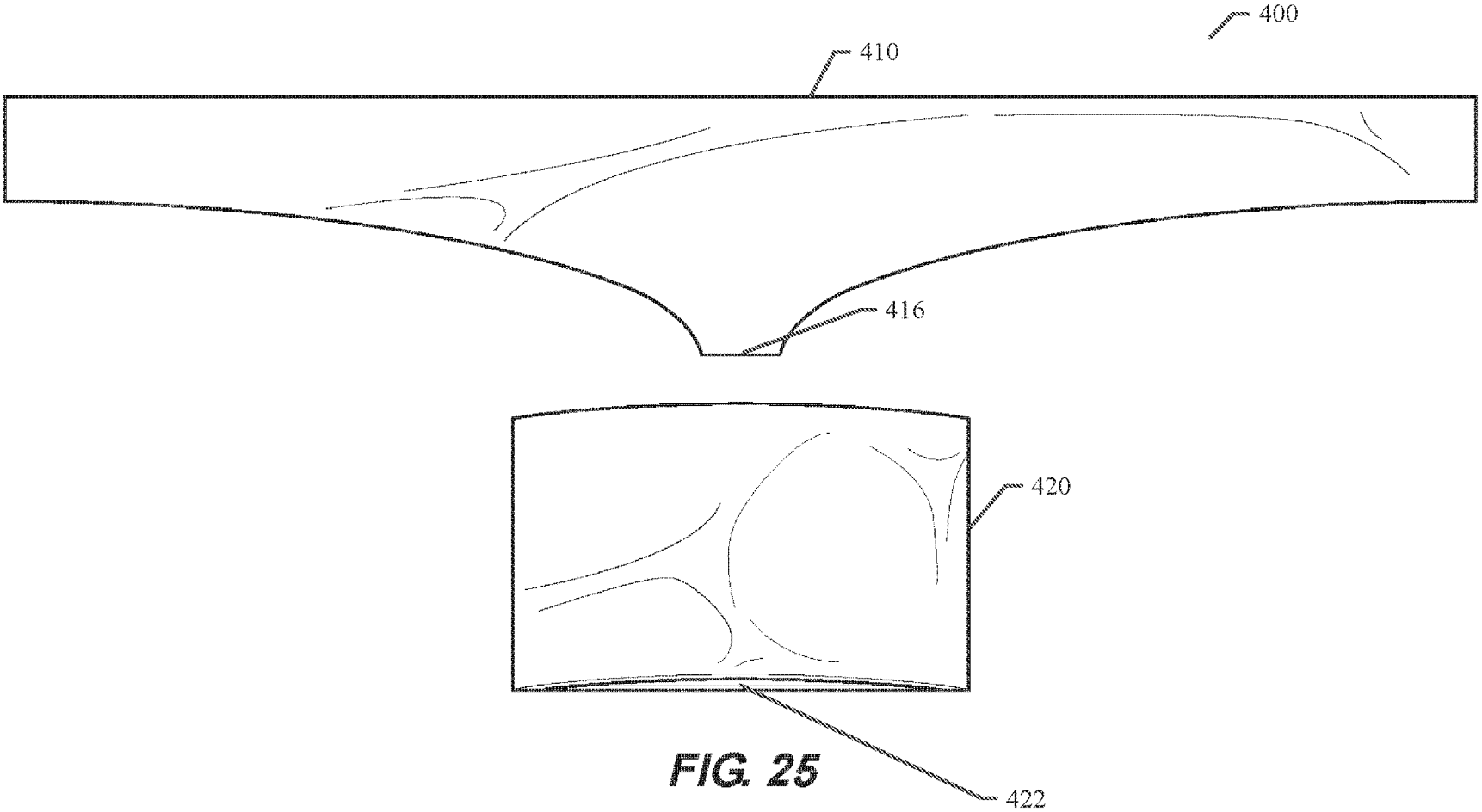
FIG. 25 illustrates a top plan view of a leg-attachable child wrap with a single loop leg wrap portion showing a detachable connecting portion according to an example embodiment.

FIG. 25 illustrates a top plan view of a leg-attachable child wrap 400 with a single loop leg wrap portion 420 showing a detachable connecting portion 416 according to an example embodiment. In the example embodiment, the connecting portion 416 can be detachable to enable connection or separation of the child wrap portion 410 to/from the leg wrap portion 420. The detachable connecting portion 416 can be implemented with snaps, hook and loop (Velcro™) strips, zipper, buttons, or other detachable connection means. The detachable connecting portion 416 enables the customization of the leg-attachable child wrap 400 so that different sizes or colors of child wrap portions 410 can be used with different sizes or colors of leg wrap portions 420.

Figure 26:
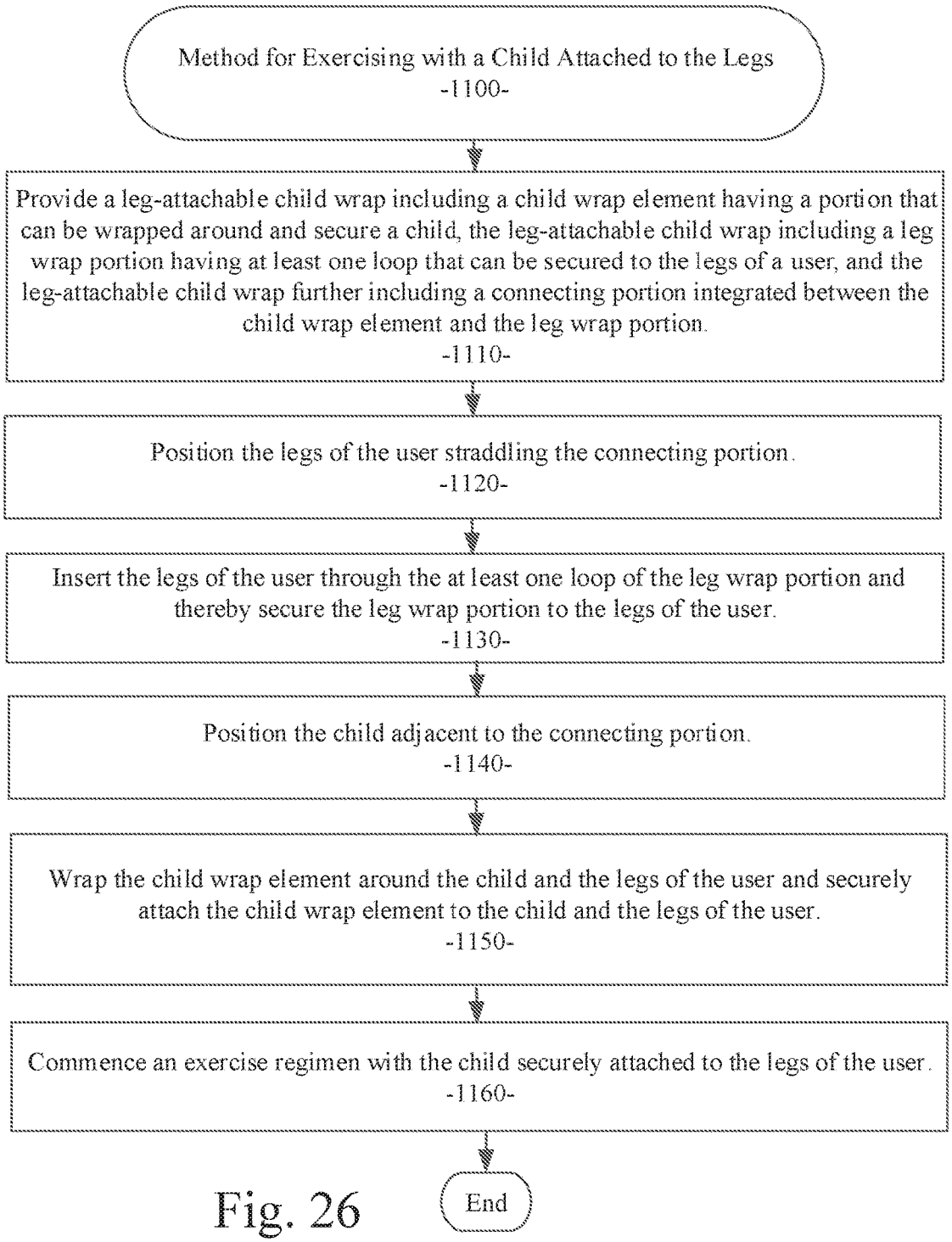
FIG. 26 illustrates a flow diagram representing a sequence of operations performed in a method according to an example embodiment.

FIG. 26 illustrates a flow diagram representing a sequence of operations performed in a method according to an example embodiment. In accordance with the example method 1100, the method comprises: providing a leg-attachable child wrap including a child wrap element having a portion that can be wrapped around and secure a child, the leg-attachable child wrap including a leg wrap portion having at least one loop that can be secured to the legs of a user, and the leg-attachable child wrap further including a connecting portion integrated between the child wrap element and the leg wrap portion (operation 1110); positioning the legs of the user straddling the connecting portion (operation 1120); inserting the legs of the user through the at least one loop of the leg wrap portion and thereby securing the leg wrap portion to the legs of the user (operation 1130); positioning the child adjacent to the connecting portion (operation 1140); wrapping the child wrap element around the child and the legs of the user and securely attaching the child wrap element to the child and the legs of the user (operation 1150); and commencing an exercise regimen with the child securely attached to the legs of the user (operation 1160).

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense. In particular, the leg-attachable child wrap, in various embodiments of the leg-attachable apparatus for exercising with a child, can be fabricated in any size or with any dimensions—for a very large adult down to a small child being able to use the leg-attachable apparatus for exercising with a stuffed animal or doll while a parent is working out with a leg-attachable apparatus for exercising with a baby or child.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, an apparatus and method for exercising with a child attached to the legs is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A method for exercising with a child, the method comprising:

providing a leg-attachable exercise apparatus including a child wrap element having a portion configured to wrap around the body of a child to secure the child to the legs of a user, at least a portion of the child wrap element is wide enough to cover the torso of the child, a leg wrap element having a single loop configured to wrap around both legs of a user to secure the user's legs together, the leg wrap element extending at least from the ankles to the calves of the user and enabling the body of the child to be positioned on and supported by the leg wrap element while the leg wrap element is attached to the legs of the user thereby preventing the child from falling through the legs of the user, and a connecting portion integrated between the child wrap element and the leg wrap element, the connecting portion being tapered with a wide portion adjacent to a lower edge of the child wrap element and a narrow portion adjacent to an upper edge of the leg wrap element, the connecting portion being configured for positioning between the legs of the user while the connecting portion is also positioned between the legs of the child while the child wrap element is secured to the child and the leg wrap element is secured to the legs of the user;

inserting the legs of the user through the single loop of the leg wrap element and thereby securing the leg wrap element to the legs of the user;

positioning the child adjacent to the connecting portion;

wrapping the child wrap element around the child and the legs of the user and securely attaching the child wrap element to the child and the legs of the user; and commencing an exercise regimen with the child securely attached to the legs of the user.

2. The method of claim 1 wherein the portion of the child wrap element is configured to be tied.

3. The method of claim 1 wherein the portion of the child wrap element is fastened together with a releasable fastener of a type from the group consisting of: a hook and loop fastener, a buckle, clips, ratchets, slide catches, and buttons.

4. The method of claim 1 including securing the child in a head up, supine position, where the child's head is toward the user's head.

5. The method of claim 1 including securing the child in a head down, prone position, where the child's head is toward the user's feet.

6. The method of claim 1 wherein the leg-attachable exercise apparatus is fabricated from a single material of a type from the group consisting of: cotton, synthetic materials, wool, canvas, plastic, linen, rubber, water-resistant materials, waterproof materials, flame or fire retardant materials, non-allergenic materials, anti-bacterial materials, plant and animal fibers, bamboo, silk, hemp, flax, ramie, mohair, camel hair, cashmere, angora wool, alpaca wool, manufactured materials, handmade materials, knitted materials, crocheted materials, woven materials, macrame materials, and quilted materials.

7. The method of claim 1 wherein the leg-attachable exercise apparatus is fabricated from a material of a type with characteristics from the group consisting of: water-resistant materials, waterproof materials, flame or fire retardant materials, non-allergenic materials, and anti-bacterial materials.

8. The method of claim 1 wherein the connecting portion is detachable between the child wrap element and the leg wrap element.

* * * * *